US006577831B1

(12) United States Patent
Kojima et al.

(10) Patent No.: US 6,577,831 B1
(45) Date of Patent: Jun. 10, 2003

(54) ELECTROPHOTOGRAPHIC IMAGE FORMING APPARATUS TO WHICH A PROCESS CARTRIDGE IS DETACHABLY MOUNTABLE AND PROCESS CARTRIDGE HAVING A SUPPORTING MEMBER FOR ROTATABLY SUPPORTING A DEVELOPING ROLLER AT A POSITION AWAY FROM THE CENTER OF ROTATION THEREOF

(75) Inventors: Hisayoshi Kojima, Mishima (JP); Atsushi Numagami, Hadano (JP); Kazunari Murayama, Shizuoka-ken (JP); Nobuharu Hoshi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/537,305

(22) Filed: Mar. 29, 2000

(30) Foreign Application Priority Data

Mar. 29, 1999 (JP) ..... 11-085540

(51) Int. Cl.[7] ..... G03G 15/04; G03G 15/08
(52) U.S. Cl. ..... 399/111; 399/119; 399/279
(58) Field of Search ..... 399/111, 113, 399/119, 265, 279, 274, 284

(56) References Cited

U.S. PATENT DOCUMENTS

| | | | | |
|---|---|---|---|---|
| 4,339,196 A | * | 7/1982 | Beck et al. | 399/119 |
| 4,373,468 A | * | 2/1983 | Suda et al. | 399/274 X |
| 4,794,420 A | * | 12/1988 | Ohashi et al. | 399/75 |
| 4,814,816 A | * | 3/1989 | Idenawa | 399/279 X |
| 4,835,565 A | * | 5/1989 | Nagatsuna et al. | 399/119 |
| 5,089,849 A | * | 2/1992 | Hiraoka | 355/211 |
| 5,235,383 A | | 8/1993 | Tada et al. | 355/200 |
| 5,249,026 A | | 9/1993 | Kojima | 355/327 |
| 5,258,811 A | * | 11/1993 | Miyake et al. | 399/279 X |
| 5,283,616 A | | 2/1994 | Numagami et al. | 355/245 |
| 5,383,011 A | | 1/1995 | Numagami et al. | 355/298 |

(List continued on next page.)

FOREIGN PATENT DOCUMENTS

JP 9-204101 * 8/1997

OTHER PUBLICATIONS

Patent Abstracts of Japan, vol. 1996, No. 01, Jan. 31, 1996 (JP 7–234552).
Patent Abstracts of Japan, vol. 1997, No. 12, Dec. 25, 1997 (JP 9–204101).
Patent Abstracts of Japan, vol. 1996, No. 05, May 31, 1996 (JP 8–015985).

*Primary Examiner*—Fred L. Braun
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive drum, a developing roller for developing an electrostatic latent image formed on the electrophotographic photosensitive drum with a developer, a frame for rotatably supporting the electrophotographic photosensitive drum, a developing blade, provided in the frame, for regulating the amount of the developer applied on a peripheral surface of the developing roller, a supporting member, journaled in the frame for rotation about a center of rotation, for rotatably supporting the developing roller at a position away from the center of rotation thereof, and an urging member for elastically urging the supporting member to urge the developing roller toward the electrophotographic photosensitive drum.

16 Claims, 29 Drawing Sheets

U.S. PATENT DOCUMENTS 5,442,421 A 8/1995 Kojima ..... 355/211
5,450,166 A * 9/1995 Yashiro ..... 355/210
5,471,284 A 11/1995 Fujii et al. ..... 355/210
5,497,220 A 3/1996 Inomata et al. ..... 344/245
5,500,714 A 3/1996 Yashiro ..... 355/200
5,521,693 A 5/1996 Kojima et al. ..... 355/326
5,543,898 A 8/1996 Shishido et al. ..... 355/210
5,585,895 A 12/1996 Yashiro ..... 355/215
5,617,579 A 4/1997 Yashiro et al. ..... 399/114
5,678,148 A * 10/1997 Owada et al. ..... 399/279
5,689,774 A 11/1997 Shishido et al. ..... 399/111
5,740,499 A 4/1998 Higeta et al. ..... 399/105
5,745,824 A * 4/1998 Yashiro ..... 399/113
5,768,658 A 6/1998 Watanabe et al. ..... 399/111
5,790,923 A 8/1998 Oguma et al. ..... 399/106
5,805,959 A 9/1998 Hazama et al. ..... 399/111
5,809,374 A 9/1998 Tsuda et al. ..... 399/111
5,897,246 A * 4/1999 Yamashita ..... 399/274 X
5,920,753 A 7/1999 Sasaki et al. ..... 399/111
5,937,239 A 8/1999 Watanabe et al. ..... 399/111
5,937,242 A 8/1999 Yokohama et al. ..... 399/114
5,940,657 A 8/1999 Yokomori et al. ..... 399/119
5,950,049 A 9/1999 Yokomori et al. ..... 399/119
5,963,759 A 10/1999 Kojima et al. ..... 399/111
5,966,566 A 10/1999 Odagawa et al. ..... 399/109
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/111

* cited by examiner

ELECTROPHOTOGRAPHIC IMAGE FORMING APPARATUS TO WHICH A PROCESS CARTRIDGE IS DETACHABLY MOUNTABLE AND PROCESS CARTRIDGE HAVING A SUPPORTING MEMBER FOR ROTATABLY SUPPORTING A DEVELOPING ROLLER AT A POSITION AWAY FROM THE CENTER OF ROTATION THEREOF

FIELD OF THE INVENTION AND RELATED ART

The present invention relates to a process cartridge detachably mountable to a main assembly of an electrophotographic image forming apparatus.

The electrophotographic image forming apparatus forms an image on a recording material through an electrophotographic image-formation-type process. Examples of the electrophotographic image forming apparatus include an electrophotographic copying machine, an electrophotographic printer (a laser beam printer or mountable LED printer), a facsimile machine, a word processor, and the like.

The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge that is detachably mountable to the main assembly of the image forming apparatus. Furthermore, the process cartridge may contain at least the electrophotographic photosensitive drum and the developing means.

Heretofore, in an electrophotographic image forming apparatus using the electrophotographic image process, a process-cartridge type is a type in which the electrophotographic photosensitive member and process means, actable on the electrophotographic photosensitive member, are integrally contained in a cartridge, which is detachably mountable to the main assembly of the image forming apparatus. In such a process-cartridge type, the maintenance of the apparatus can be carried out by the users without servicemen, and therefore, the operativity can be improved significantly, and for this reason, it is widely used in image forming apparatus.

An example of such a process cartridge includes a toner-developing frame having a developing frame supporting developing means and a toner-developing frame having a toner container accommodating the toner, and a cleaning frame rotatably supporting the photosensitive drum and having cleaning means, wherein the toner developing frame and the cleaning frame are coupled such that they are pivotable relative to each other about an axis parallel with the photosensitive drum. The process cartridge further includes an urging member for urging the photosensitive drum and the developing roller of the developing means toward each other.

SUMMARY OF THE INVENTION

The present invention provides further developments.

Accordingly, it is a principal object of the present invention to provide a process cartridge and an electrophotographic image forming apparatus wherein the positional relation between an electrophotographic photosensitive drum and a developing roller can be correctly maintained.

It is another object of the present invention to provide a process cartridge and an electrophotographic image forming apparatus wherein the positional relation between a developing roller and an electrophotographic photosensitive drum can be correctly maintained, in which no additional cleaning means is used.

According to an aspect of the present invention, there is provided an electrophotographic image forming apparatus and a process cartridge usable therewith comprising an electrophotographic photosensitive drum;

- a developing roller for developing an electrostatic latent image formed on the electrophotographic photosensitive drum with a developer;
- a frame for rotatably supporting the electrophotographic photosensitive drum;
- a supporting member, rotatably supported in the frame, for rotatably supporting the developing roller at a position away from a rotational center thereof; and
- an urging member for elastically urging the frame to urge the developing roller toward the electrophotographic photosensitive drum.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A description will be provided as to the preferred embodiments of the present invention.

In the following description, the longitudinal direction is a direction crossing a feeding direction of a recording material, that is, the direction parallel to the recording material. The left and right directions refer to directions as seen in the feeding direction of the recording material. The top of the process cartridge is the top of the cartridge when the process cartridge is mounted in place.

Figure 1:
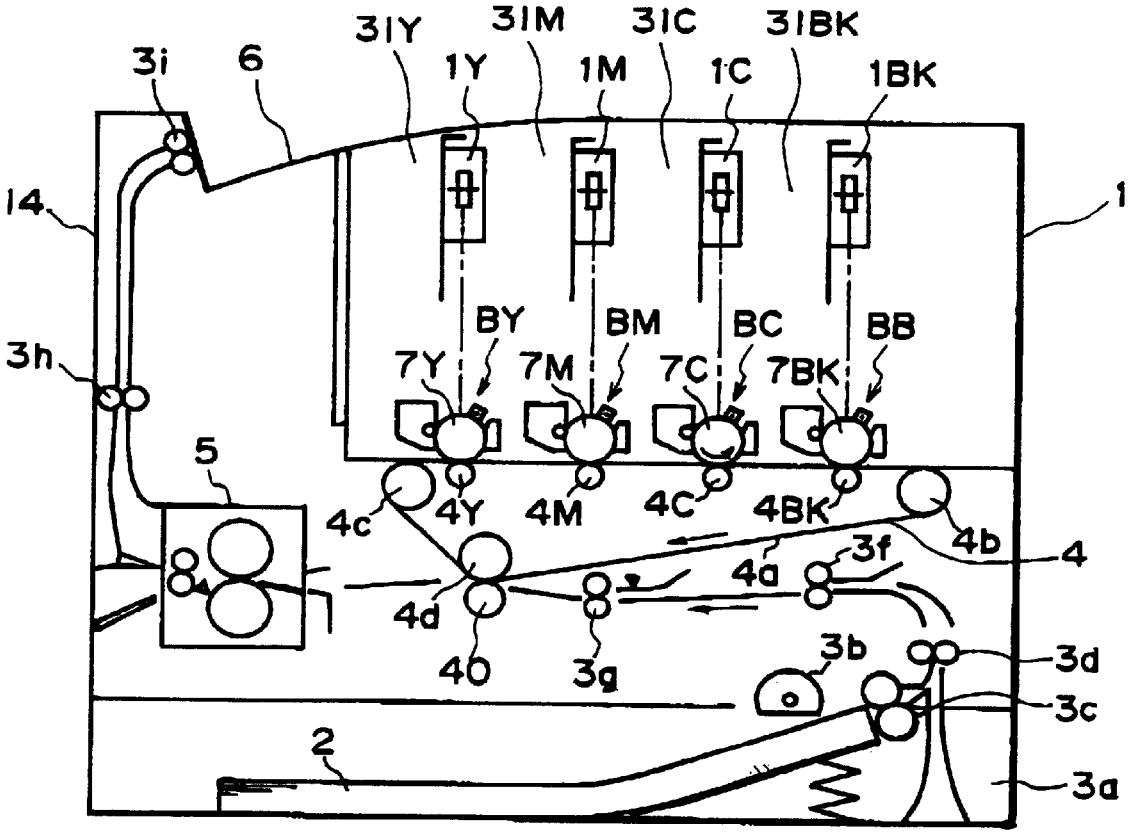
FIG. 1 is a longitudinal sectional view of an electrophotographic image forming apparatus.

Referring to FIG. 1, there is shown an image forming apparatus to which the present invention is applied. The image forming apparatus comprises image formation stations 31Y, 31M, 31C, 31BK for forming toner images on the image bearing member in the form of a photosensitive drum, an intermediary transfer belt 4*a* for temporarily transferring the toner image, a secondary transfer roller 40 (transferring means) for transferring the toner image to the recording material 2, sheet feeding means for feeding the recording material 2 out to between the secondary transfer roller 40, feeding means for feeding the recording material 2 to the transferring means, fixing means and sheet discharging means.

A description will be provided as to image forming operations.

As shown in the figure, the image forming apparatus is provided with a sheet feeding cassette 3*a* for accommodating recording materials (recording paper, an OHP sheet, textile or the like) 2, the sheet feeding cassette 3*a* being detachably mountable to the image forming apparatus. The recording material 2 fed out of the sheet feeding cassette 3*a* by a pick-up roller 3*b*, is separated one by one by a pair of retard rollers, and is fed to a pair of registration rollers 3*g* by feeding rollers 3*d*, 3*f*.

When the recording material 2 is fed out, the registration rollers 3*g* are not rotated, and the recording material 2 abuts the nip formed between the registration rollers by which the inclination of feeding is corrected.

The process cartridges BY, BM, BC, BB including image bearing members for yellow, magenta, cyan and black colors, are disposed parallel to each other, in the case of a four-drum full color type. For the respective process cartridges BY, BM, BC, BB, there are provided scanning optical systems 1Y, 1M, 1C and 1BK, and toner images are formed on the associated photosensitive drums for the colors, corresponding to image signals, and then, the color toner images are superposedly transferred onto the intermediary transfer belt 4*a*, which is traveling in the direction indicated by the arrow by transfer rollers 4 (4Y, 4M, 4C, 4BK).

Thereafter, the recording material 2 is fed at a predetermined timing to the next transfer roller 40, and the toner image on the intermediary transfer belt 4*a* is transferred onto the recording material 2, and the toner image is fixed by a fixing device 5, and then, the recording material 2 is discharged and stacked on a tray 6 of the main assembly 14 of the apparatus.

The image formation stations 31Y, 31M, 31C, 31BK are provided by the process cartridges BY, BM, BC, BB, except for the scanning optical systems 1Y, 1M, 1C and 1BK. Since the process cartridges have substantially the same structures, and therefore, a description will be provided as to the process cartridge BY.

Figure 2:
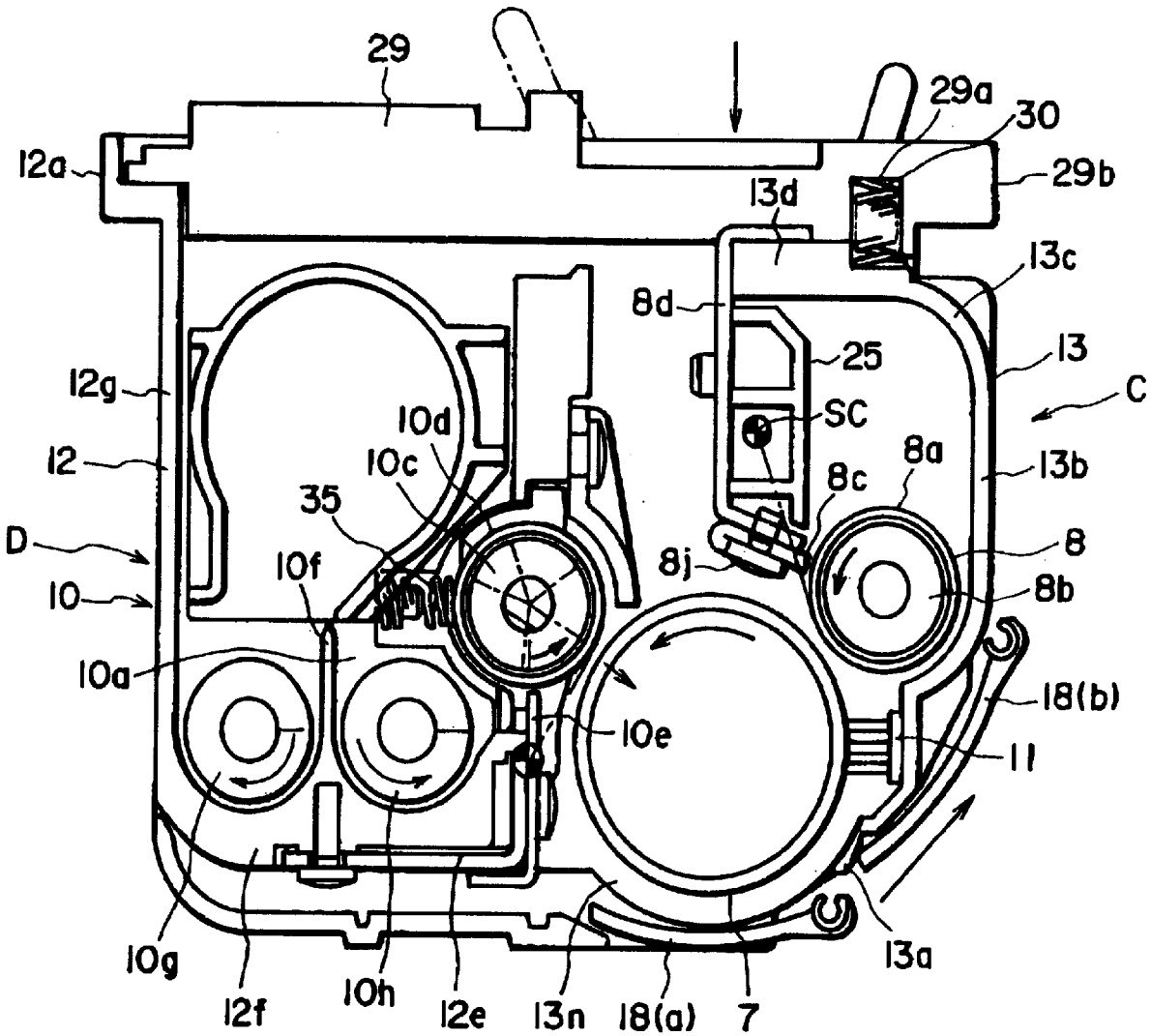
FIG. 2 is a longitudinal sectional view of a process cartridge.

As shown in FIG. 2, the process cartridge BY is provided around the photosensitive drum 7 with charging means, exposure portion, developing means and a transfer opening. In such an embodiment, the developer is a two-component developer comprising magnetic carrier powder. The photosensitive drum 7 may have a usual organic photosensitive member or the like, and preferably, it is provided with a surface leader having a volume resistivity of 10$2$–10$14$. Or, it may be an amorphous silicon photosensitive member. Using one of these examples is preferable because charge injection charging (injection charging) is usable in which ozone production can be avoided, and electric energy consumption can be saved. Additionally, the charge potential can be increased.

In this embodiment, the photosensitive drum 7 comprises a drum base member of aluminum and an organic photosensitive layer having a negative charging property.

The charging means is in the form of a magnetic brush charger 8 using a magnetic carrier.

The charger 8 includes a charging roller 8*a* in the form of a hollow cylindrical member supported rotatably, and a stationary magnet 8*b* therein. After the image transfer, the toner remaining on the photosensitive drum 7 is taken into the charger 8 rotating in the direction indicated by an arrow.

In this embodiment, the developing means uses a developing method with a two-component developer used in a contacted state (non-contact type).

In FIG. 2, there is shown developing means 10 which effects the two-component magnetic brush development. The developing roller 10*d* is in the form of a hollow cylindrical member and is rotatably supported. In the developing roller 10*d*, a stationary magnet is disposed. The developing roller 10*d* rotates in the same direction as the photosensitive drum 7, and the peripheral surface thereof is moved in the opposite direction relative to the moving direction of the peripheral surface of the photosensitive drum 7. The photosensitive drum 7 and the developing roller 10*d* are placed out of contact from each other with a gap of approximately 0.2–1.0 mm, which permits the developer to contact the photosensitive drum 7 while the development is carried out.

The toner with the carrier particles mixed therein, is supplied by a stirring screw 10*g* in a casing separated by longitudinally extending partition 10*f* except for the opposite ends. The toner supply from an unshown toner supply container falls toward one end side of the stirring screw 10*g*, and is fed in one longitudinal direction, during which it is stirred. It is fed to one end by a stirring screw 10*h* by way of the other side not having the partition 10*f*. Then, it is fed by a stirring screw 10*h* by way of the one end without the partition 10*f*, during which it is stirred. It is circulated in this manner.

A description will be provided as to a developing process for visualizing the electrostatic latent image form on the photosensitive drum 7 through a two-component magnetic brush method by the developing device 4 and as to the circulation system. The developer is taken up by a magnetic pole of a magnet 10*c* and is regulated and formed into a thin layer on the developing roller 10*d* by a regulating blade 10*e*, which is disposed perpendicularly to the developing roller 10*d*, while the developer is carried on the developer roller 10*d*. More particularly, the developing blade 10*e* is effective to regulate the amount of the developer deposition on the peripheral surface of the developing roller. When the developer in the form of a thin layer reaches a main developing pole, it is erected into chains by the magnetic force of the main developing pole. By the developer in the form of the chains, the electrostatic latent image is developed, and then, the developer on the developing roller 10*d* is returned into the developing container by a repelling magnetic field.

The developing roller 10*d* is supplied with a DC voltage and an AC voltage from an unshown voltage source. Generally, in a two component developing method, the application of the AC voltage is effective to increase the development efficiency, and therefore, a high quality of the image is provided, but correspondingly, the image tends to be foggy. In order to avoid this, it is usual to provide a potential difference between the DC voltage applied to the developing roller 10*d* and the surface potential of the photosensitive drum 7 by which the deposition of the toner to the non-image region occurs during the developing operation.

The toner image is then transferred onto the intermediary transfer belt 4*a* by the intermediary transfer device 4. The intermediary transfer device 4 includes an endless belt 4*a*, a driving roller 4*b*, a follower roller 4*c*, and a secondary transfer roller 4*d*, around which the belt 4*a* is extended, and the belt 4*a* is rotated in a direction indicated by an arrow in FIG. 1. In the region within the endless path of the transfer belt 4*a*, there are provided transfer charging rollers 4Y, 4M, 4C, 4BK, each of which is urged from the inside of the belt 4*a* toward the photosensitive drum 7 while it is supplied with a voltage from a high voltage source so that the electric charge of the polarity opposite from the toner to the back side of the belt 4*a* is applied, by which the toner image is continuously transferred onto the top side of the intermediary transferred onto the top side of the intermediary transfer belt 4*a*.

The material of the intermediary transfer belt 4*a* may be polyamide resin material. Other usable material of the belt 4*a* includes dielectric material such as polycarbonate resin material, polyethylene terephthalate resin material, polyvinylidene fluoride resin material, polyethylenenaphthalate resin material, polyetheretherketone resin material, polyether sulfone resin material, polyurethane resin material or the like plastic resin material, or rubber material centers fluorine, silicon or the like rubber material.

After the toner-image transfer, untransferred toner remains on the surface of the photosensitive drum 7. If the untransferred toner is passed by the charger, the potential after passing by the charger is not even, and more particularly, the portion having the residual toner acquires a lower potential with the result of a ghost image occurring in the next image forming process. Even if the untransferred toner is contacted by the charging magnetic brush, the ghost is not removed. It is therefore desirable that untransferred toner carried to the charging region by the rotation of the photosensitive drum 7 is taken into the magnetic brush charger 8 to remove the hysteresis. Here, the untransferred toner on the photosensitive drum 7 may charge positive and negative polarity (mixed) due to separation discharge in the image transfer operation. In consideration of easy catching of the toner by the magnetic brush charger 8, the untransferred toner is desirably charged to the positive polarity.

In this embodiment, an electroconductive brush 11 contacts the photosensitive drum 7 between the intermediary transfer device 4 and the magnetic brush charger 8 to apply a bias voltage of a polarity opposite from the charging bias. The untransferred toner of the positive polarity is passed by the magnetic brush charger 8 by which the untransferred toner of the negative polarity is temporarily caught by electroconductive brush 11 and is discharged, and then discharged to the photosensitive drum 7. By doing so, the untransferred toner becomes more easily removed by the magnetic brush.

(Structure of Frames of Process Cartridge)

The process cartridge B(BY, BM, BC, BB) comprises a developing unit D including the electrophotographic photosensitive drum 7, the developing means 10 and the developing frame 12 integrally supporting them, and a charging unit C including a charging roller 8*a*, a regulating blade 8*c*, a charging brush 11 and so on and a charging frame 13 integrally supporting them. At opposite longitudinal ends, the developing unit D and the charging unit C are positioned and coupled by a front cover 16 and a rear cover 17 (FIG. 4).

Figure 3:
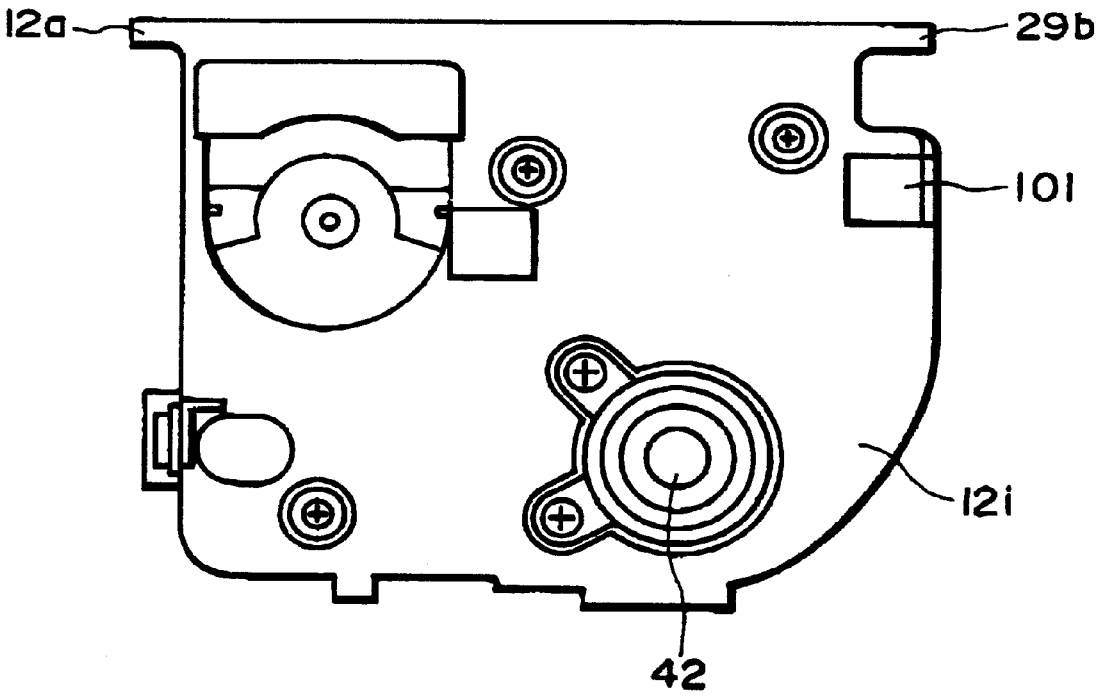
FIG. 3 is a front view of a process cartridge.
Figure 4:
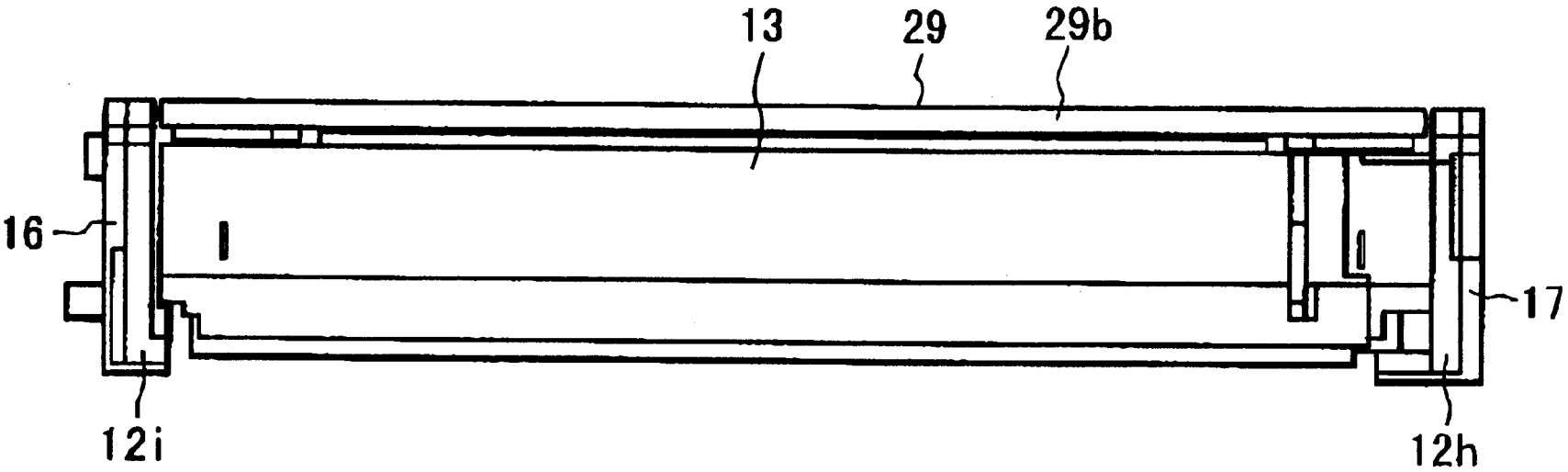
FIG. 4 is a right side view of a process cartridge.
Figure 5:
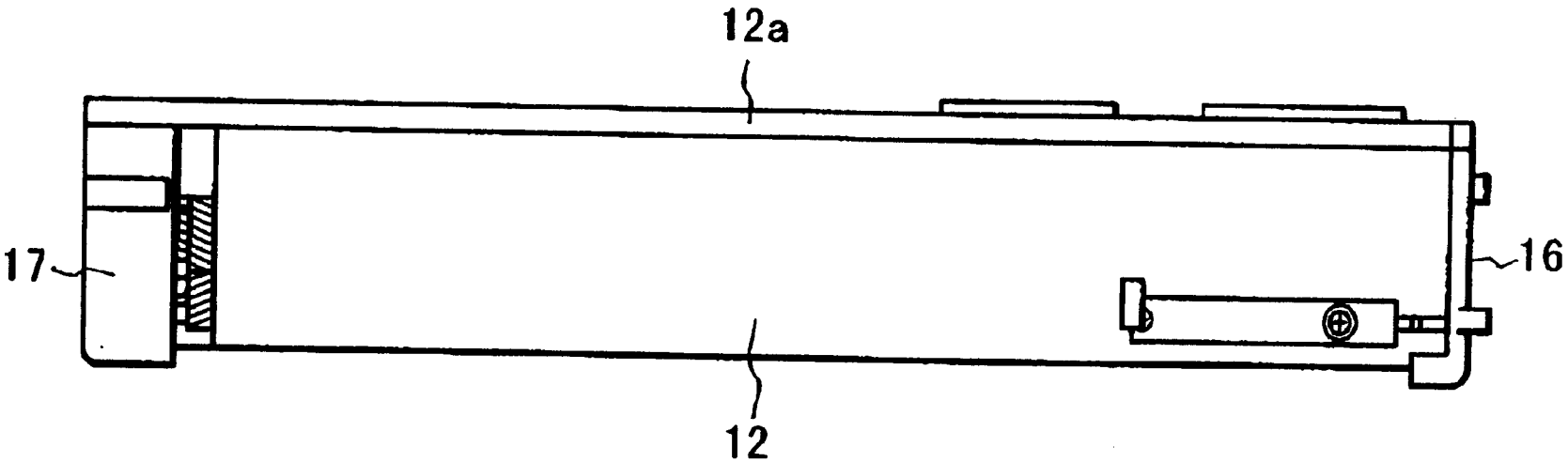
FIG. 5 is a left side view of a process cartridge.
Figure 6:
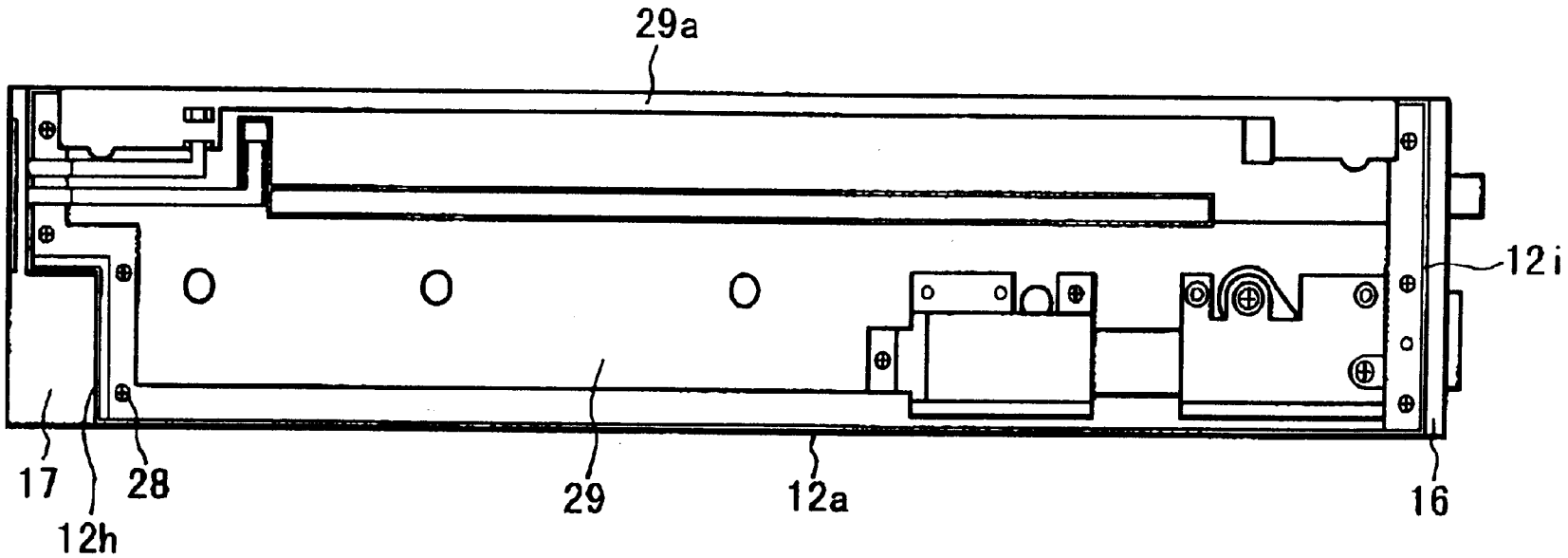
FIG. 6 is a top plan view of a process cartridge.
Figure 7:
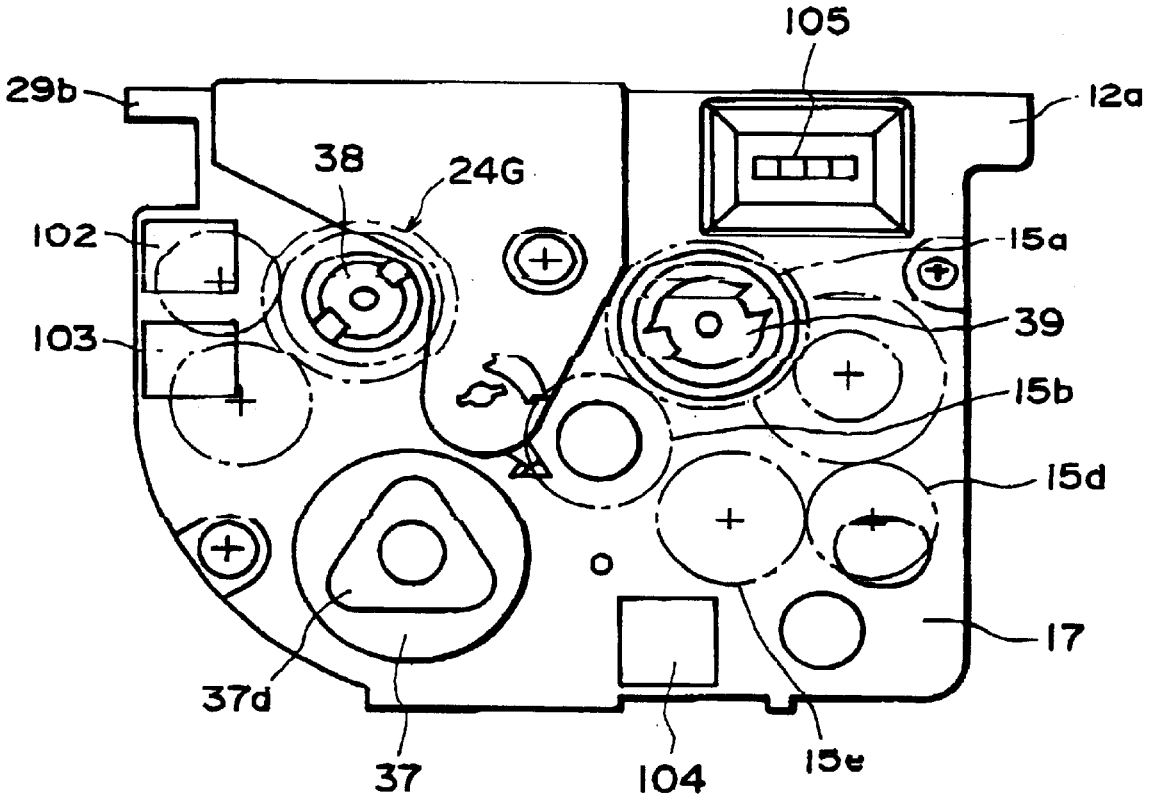
FIG. 7 is a rear view of a process cartridge.
Figure 8:
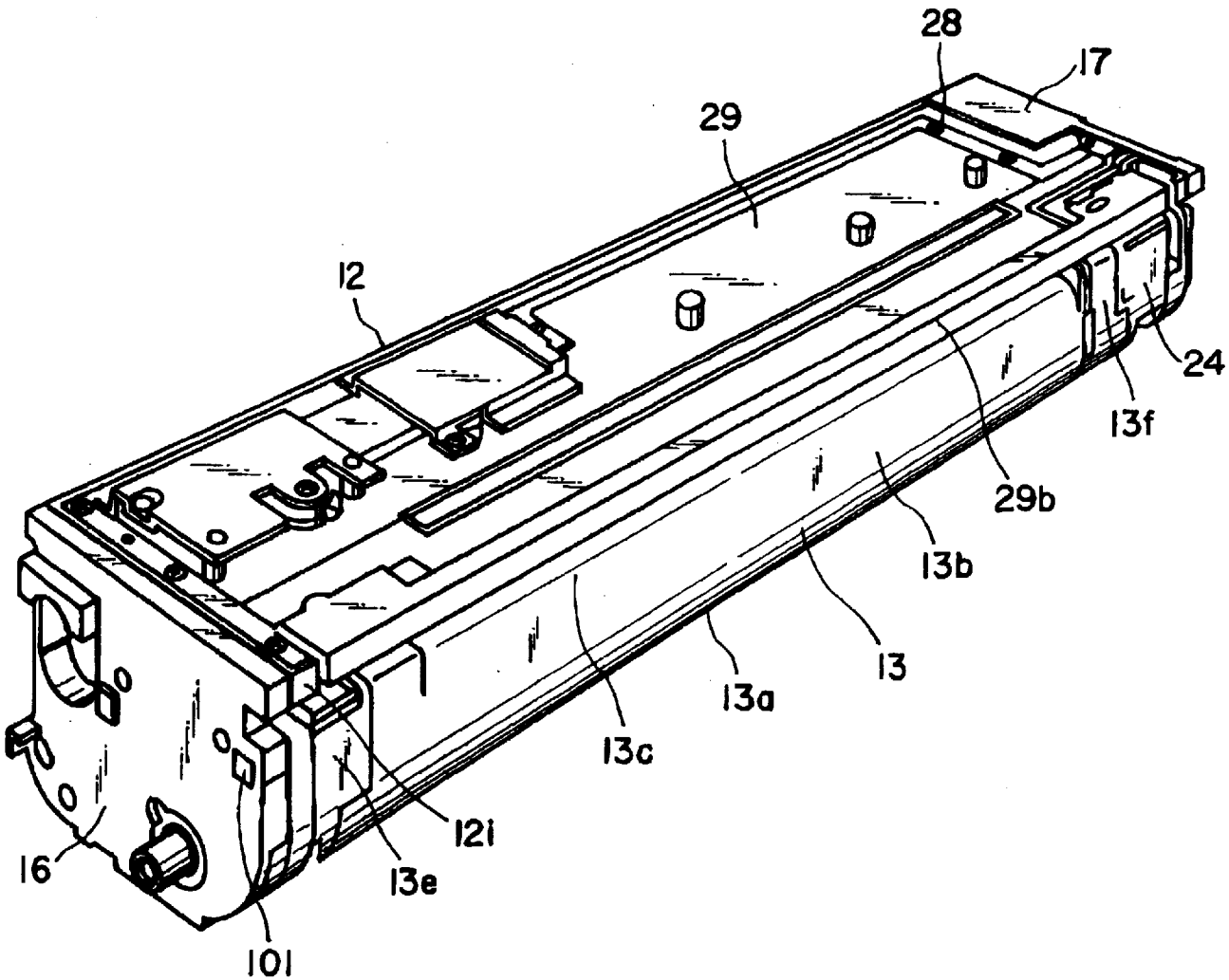
FIG. 8 is a perspective view of a process cartridge as seen from the front right side.
Figure 9:
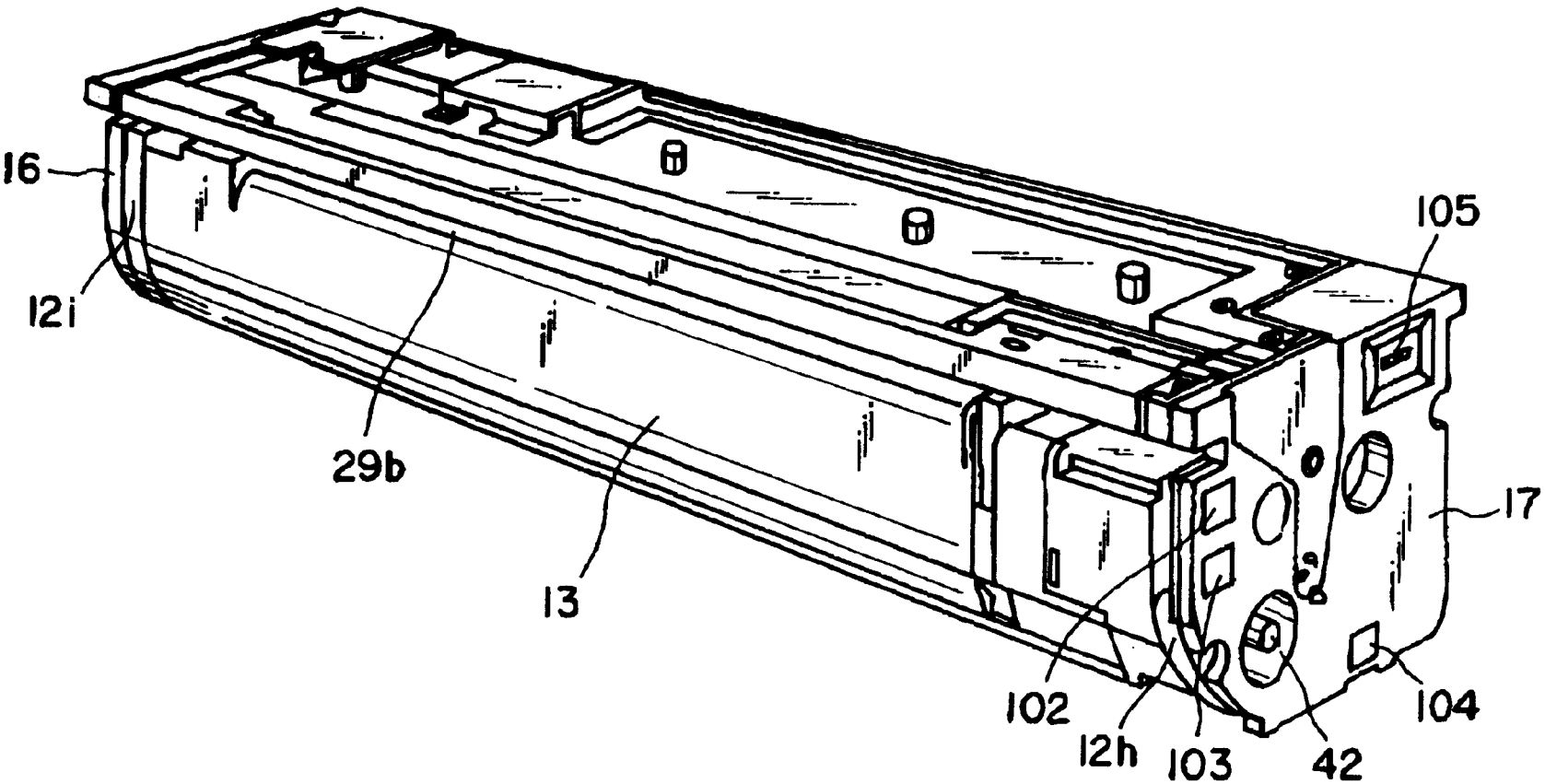
FIG. 9 is a perspective view of a process cartridge as seen from the rear left side.
Figure 10:
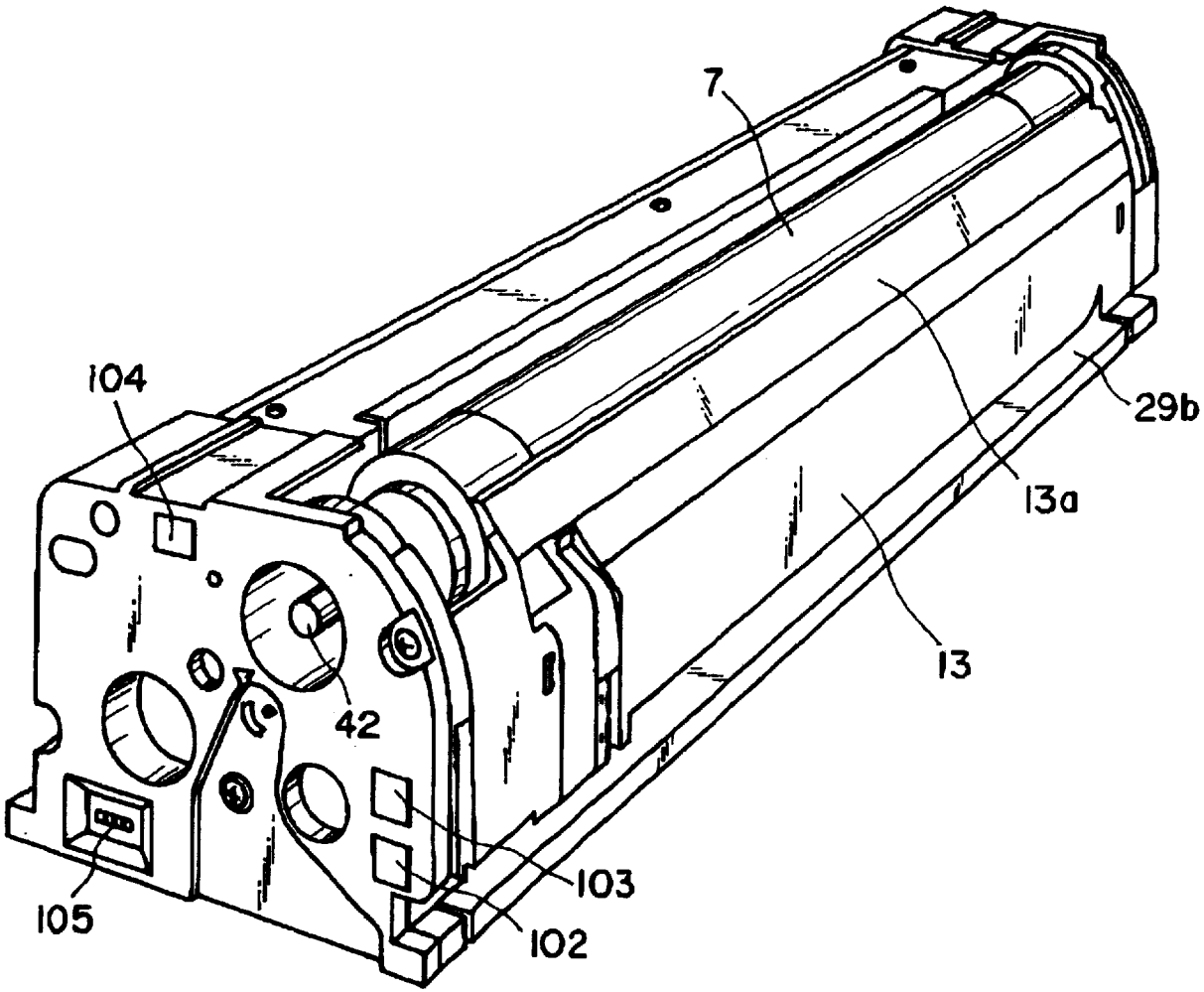
FIG. 10 is a perspective view of a process cartridge wherein the process cartridge is upside down and seen inclindely from the rear side.

FIGS. 3–7 are projection figures of the process cartridge B(BY, BM, BC, BB). FIG. 3 is a front view, FIG. 4 is a right side view, FIG. 5 is a left side view, FIG. 6 is a top plan view, and FIG. 7 is a rear view. FIGS. 8–10 are perspective views of an outer appearance of the process cartridge B. FIG. 8 is a perspective view as seen inclinedly from the front side thereof, FIG. 9 is a perspective view as seen inclinedly from the rear side thereof, and FIG. 10 is a perspective view thereof positioned upside down.

As shown in FIG. 2, the charging unit C integrally contains the charging roller 8*a*, the regulating blade 8*c* and the electroconductive brush 11, which are supported in the charging frame 13. As shown in FIGS. 2, 4, 8, 9 and 10, the charging frame 13 constitutes a part of the outer housing of the process cartridge B. The bottom edge 13*a* of the charging frame 13, as shown in FIGS. 2 and 10, is parallel with the longitudinal direction of the photosensitive drum 7 adjacent to but with a gap from the photosensitive drum 7. From the bottom edge 13*a*, upper and lower walls 13*b* constitute also the outer housing and extend vertically and are bent to form corner portions 13*c* at the top portion. From the corner portion 13*c*, a substantially horizontally extending top plate portion 13*d* is provided, and below the top plate portion 13*d*, a space is provided. At the opposite longitudinal ends, mounting portions 13C, 13*f* are formed.

Figure 11:
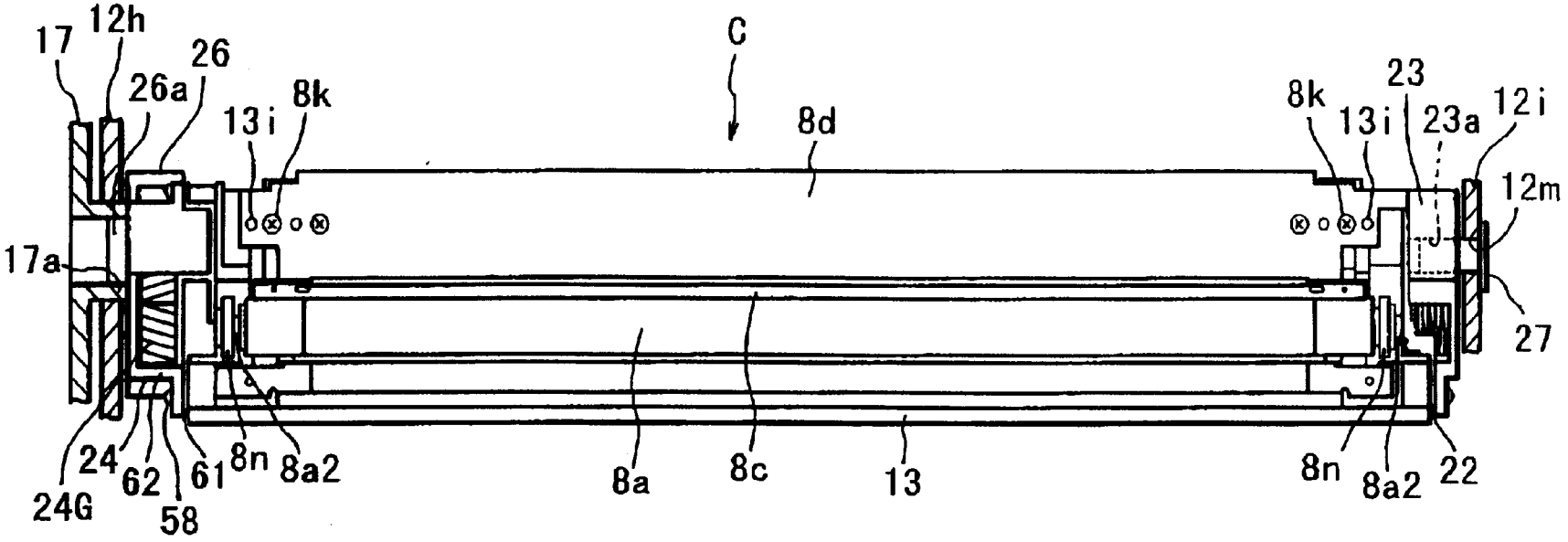
FIG. 11 is a front view of a charging unit.

FIG. 11 is a side view of the charging unit C as seen from the inside thereof. The process cartridge B is inserted into the main assembly of the apparatus through a front side thereof in the longitudinal direction of the process cartridge B. The rear end of the charging frame 13 is provided with a charging roller bearing 22 end and an end cover 23, which are secured by screws together. A gear unit 24 is secured by screws to the other end.

Figure 12:
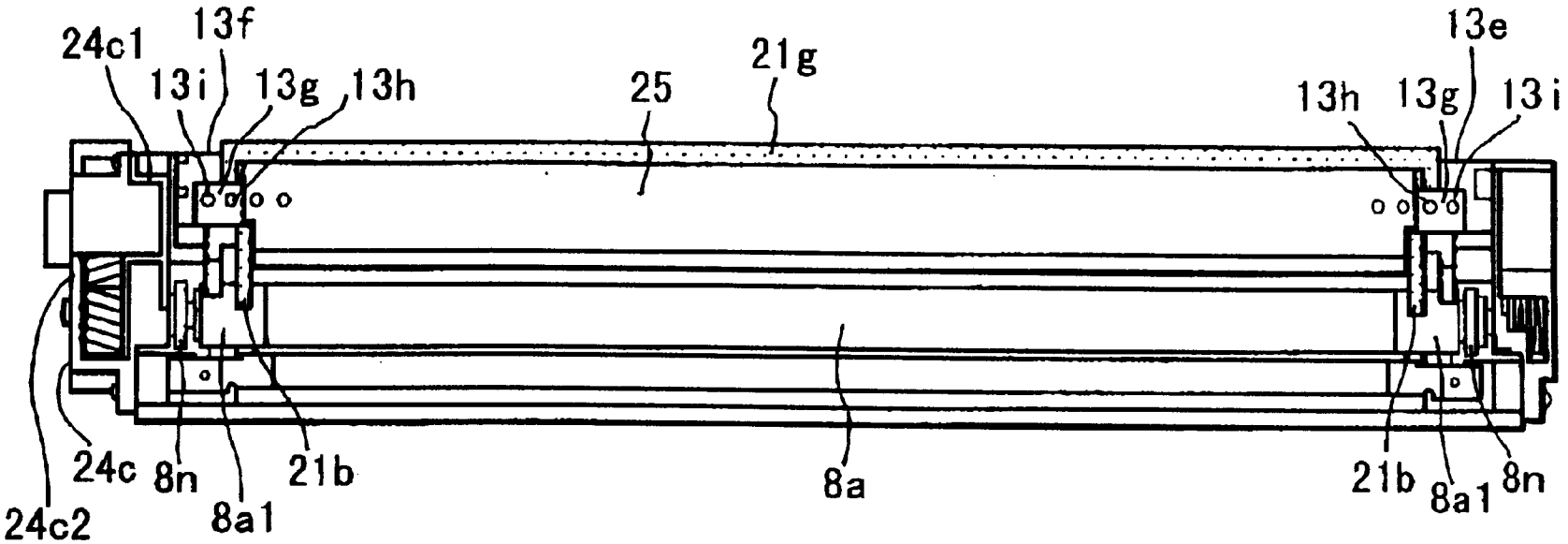
FIG. 12 is a front view of the unit of FIG. 11 without a blade.

FIG. 12 is a side view of the charging unit C with the regulating blade 8*c* and a supporting metal plate 8*d* therefor being removed, as seen from the inside thereof. A seat portion 13*g* for mounting the blade is provided as a stepped mounting portion 13C, 13*f* and is provided with a female screw 13*h* and a dowel 131 in a plane for contact to the opposite ends of the regulating blade 8*c*. A sealing material 21*g* of sponge or the like material is pasted on a flat surface retracted of the seat portion 13*g* and is extended in the longitudinal direction. A sealing material 21*b* of felt or the like material is provided along a circumferential direction of the seal portion 8*a*1 at the opposite ends of the charging roller 8*a* to prevent the developer from leaking toward outside in the axial direction. Therefore, the portion opposing to the seal portion 8*a*1 at each of the opposite ends of the charging roller 8*a* of the charging frame 13 is arcuate and concentric with the charging roller 8*a*.

The regulating blade 8*c* of metal, as shown in FIG. 2, is spaced from the charging roller 8*a*, and is fixed to the supporting metal plate 8*d* by small screws. The supporting metal plate 8*d* has a groove-shaped section, and is engaged with a dowel 131 of the seat portion 13*g* of the charging frame 13, and is penetrated through a hole of the supporting metal plate 8*d*. By fastening the small screw 8*k* into a female 13*h* of the seat portion 13*g*, the supporting metal plate 8*d* is abutted to the seat portion 13*g*, and the sealing material 21*a* is compressed by the supporting metal plate 8*d*. Additionally, the neighborhood of the seat portion 13*g* of the sealing material 21*b* is compressed by the supporting metal plate 8*d*. The supporting metal plate 8*d* has a very high rigidity, and by fixing the opposite ends thereof to the charging frame 21, the rigidity of the charging frame 21 is enhanced.

(Mounting of Charging Unit)

The charging unit C is supported on the developing frame 12 for swinging movement about a center SC as shown in FIG. 2. Therefore, as shown in FIG. 11, a gear case 26 of a gear unit 24 fixed to one end at the longitudinally rear end of the charging frame 13, is provided on the swinging center SC with a cylindrical shaft portion 26*a*, and the end cover 23 at the longitudinally opposite end is provided at the swinging center SC with a cylindrical hole 23*a*.

As shown in FIG. 2, the developing frame 12 includes a lower portion that accommodates the stirring screws 10*g* and 10*h* at both sides of the partition 10*f* and is provided with a seat portion 12C for mounting the regulating blade 10C. A side 12*g* constitutes a left side housing 12*g* as seen in the mounting direction of the process cartridge B, and end plate portions 12*h* and 12*i* at the rear and front longitudinal ends, as shown in FIGS. 13, 14, 17 and 18. One of the end plate portions 12*h* is provided with a hole 12*j* for rotatably supporting the cylindrical shaft portion 26*a* through a bearing. The other end plate portion 121 is provided with a hole 12*m* having the same diameter as the charging frame 13. While the cylindrical shaft portion 26*a* of the charging unit C is inserted in the hole 12J of the end plate portion 12*h* of the developing frame 12, the cylindrical engagement hole 23 of the charging unit C is aligned with the hole 12*m* of the end plate portion 121 of the developing frame 12. Then, the rear cover 17, which is disposed at the rear side as seen in the mounting direction of the process cartridge B, is aligned with the end of the developing frame 13, and the outer periphery of the hollow cylindrical support portion 17*a* (FIGS. 11 and 15) projected in the longitudinal direction in the rear cover 17 is engaged with the hole 12J of the developing frame 12, and simultaneously, the inner surface is engaged with the cylindrical shaft portion 26*a* of the charging unit c. Also, the supporting shaft 27 (FIGS. 11 and 14) projected in engagement with the hole 12*m* provided in the end portion 121 of the developing frame 12 is engaged with the hole 23*a* of the charging unit C. By doing so, the cylindrical shaft portion 26*a* at the one end of the charging unit C is rotatably supported to the end cover 17, and simultaneously, the hole 23*a* at the other end is engaged rotatably with the developing frame 12.

As shown in FIGS. 6 and 8, in the upper portion of the developing frame 12, a top plate 29 is fixed by small screws 28 with the periphery thereof contacting the inside end plate portions 12*h*, 121 of the guide portion 12*a* above the side plate 12*g*.

As shown in FIG. 2, the top plate 29 is provided at different longitudinal positions with spring seats 29*a*. A compression coil spring 30 supported on the spring seat 29*a* is compressed between the top plate 29 and charging frame 13. The charging unit C is biased in the clockwise direction in FIG. 2 about the swinging center SC by the spring force of spring 30.

As shown in FIG. 11, the end of the charging roller 8*a* is reduced to a small diameter into a journal portion 8*a*2 concentric with the rotational center and is provided with spacer rollers 8*n* which are rotatable. The spacer roller 8*n* is press-contacted to the area outside the image region of the photosensitive drum 7 by a spring force provided by the compression coil spring 30. With such a structure, there is provided a gap between the photosensitive drum 7 and the charging roller 8*a*, and the residual toner, brought to the position where the charging roller 8*a* and the photosensitive drum 7 are opposed to each other, is caught by the application of a charging bias voltage with the moving direction of the peripheral surface of the charging roller 8*a* being opposite from the moving direction of the peripheral surface of the photosensitive drum 7.

The line connecting the swinging center SC and the center of the charging roller 8*a* is substantially perpendicular to the line connecting the centers of charging roller 8*a* and the photosensitive drum 7.

Figure 17:
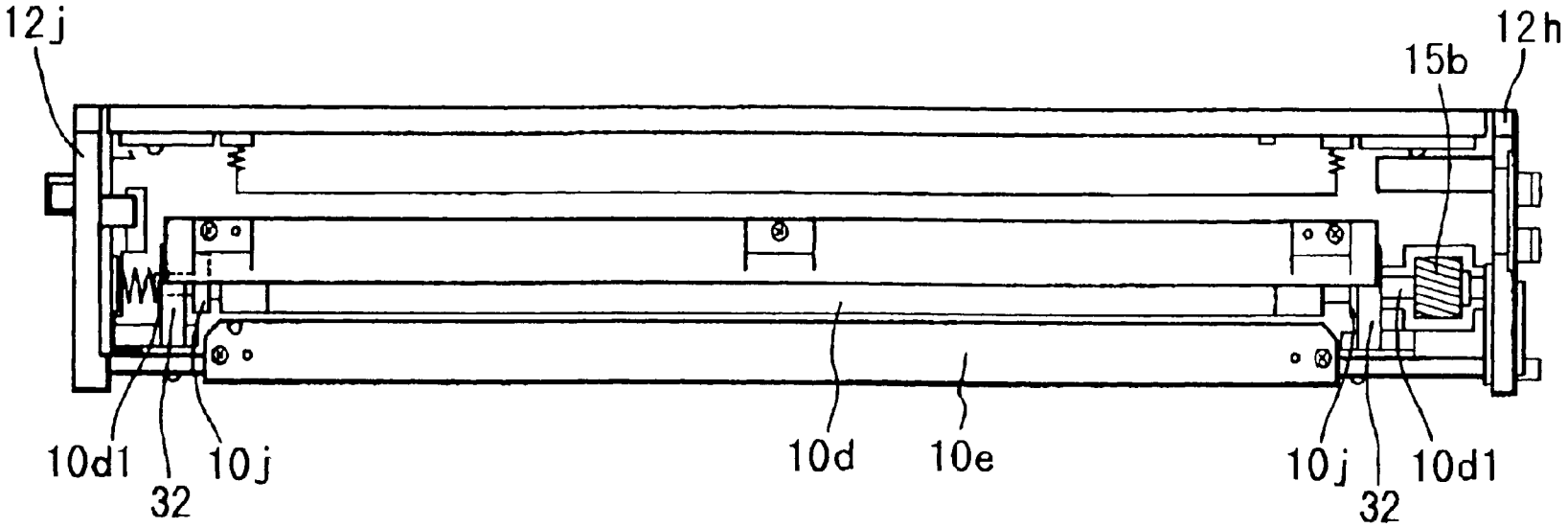
FIG. 17 is a side view of a developing unit.

As shown in FIG. 2, the developing roller 10*d* is pivotable about an SLv pressing center relative to the developing frame 12. As shown in FIG. 17, small diameter portions of developing roller 10*d* at the opposite ends are provided with spacer rollers 10J having a radius that is larger than the developing roller 10*d* by the development gap, and engaged therewith. An outside of the spacer roller 10*j* is provided with a swingable arm 32 engaged with the journal 10*d*1.

Figure 18:
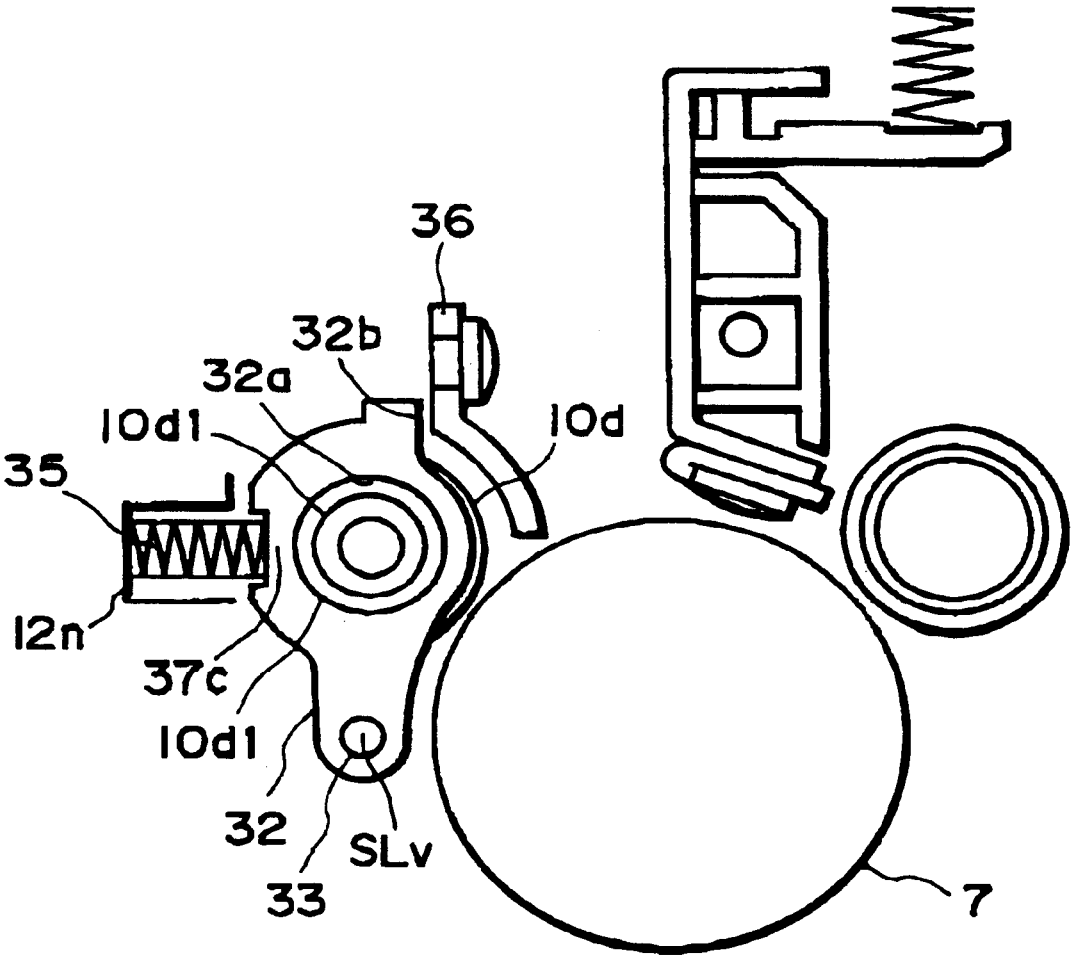
FIG. 18 is a front view of a supporting portion of a developing roller.

FIG. 18 is a sectional view taken along a plane perpendicular to the developing roller 10*d*, illustrating the portion around the side surface. A base portion of the swingable arm 32 is pivotably supported in the supporting shaft 33 press-fitted in the longitudinal direction into the end plate 12*h* and 12*i*. Substantially right above the swingable form 32 as seen from the supporting shaft 33, a bearing hole 32*a* is provided, and above it, a stopper portion 32*b* is provided. A spring seat 37*c* is provided on a line substantially perpendicular to the line connecting the pressing center SLv, which is the center of the supporting shaft 33, and the bearing hole 32*a*.

The journal portions 10*d*1 at the opposite ends of the developing roller 10*d* are rotatably supported in the bearing holes 32*a* of the swingable arm 32. A compression coil spring 35 is compressed between the spring seat 32*c* and the spring seat 12*n* provided in the end plate portion 12*h*, 12*i*. By doing so, the developing roller 10*d* is urged toward the photosensitive drum 7 by rotation about the pressing center SLv, and the spacer rollers 10J are press-contacted to the ends outside the image region of the photosensitive drum 7 so that a predetermined gap (0.2–1.0 mm) is maintained between the developing roller 10*d* and the potosensitive drum 7.

The stopper 32*b* functions to prevent the movement of the swingable arm 32 toward the outside in FIG. 18 by abutment to the developing roller cover 36 during assembling and disassembling operations. Therefore, in the process cartridge B having been assembled, the stopper 32*b* and the developing roller cover 36 are not contacted to each other. The developing roller cover 36 extends between the swingable arms 32, and is secured to the developing frame 12 by screws.

(Mounting and Demounting of Process Cartridge Relative to Image Forming Apparatus)

In the left and right parts as seen in the mounting-and-demounting direction of the process cartridge B, as shown in FIGS. 3 and 7, there are provided guide portions 12*a*, 29*b* in the form of flanges, which are engaged with unshown guiding rails extended in a direction perpendicular to the sheet of drawing of FIG. 1, when the process cartridge is mounted to and demounted from the main assembly 14 of the image forming apparatus.

There are provided electric contacts that are adapted to be contacted to the corresponding electric contacts provided in the main assembly and connected to an unshown high voltage source, when the process cartridge B is mounted to the main assembly 14 of the apparatus.

As shown in FIGS. 3 and 8, in the front side, as seen in the mounting direction of the process cartridge B, there is provided a drum grounding contact 101, which is electrically connected to the photosensitive drum 7. As shown in FIGS. 7, 9 and 10, in the rear side as seen in the mounting direction of the process cartridge B, there are provided an electroconductive brush contact 102 connected to the electroconductive brush 11, a charging bias contact 103 connected to the charging roller 8*a*, and a developing bias contact 104 electrically connected to the developing roller 10*d*.

On the rear end surface, as seen in the mounting direction of the process cartridge B, there are provided 3 driving force receiving portions as a shaft coupling rotatable about the axis. When the process cartridge B is mounted to the main assembly of the apparatus, the 3 driving force receiving portions are coupled with a driver material of the main assembly 14 of the apparatus.

As shown in FIG. 7, on the rear end surface of the process cartridge B, there are provided a drum coupling 37*d*, a charger coupling 38 and a developing device coupling 39, which are retracted from the end surface and which are exposed to the outside.

(Support and Driving for Photosensitive Drum)

The drum coupling 37*d* is formed at an end of the drum flange 37 fixed to one end of the photosensitive drum 7.

Figure 19:
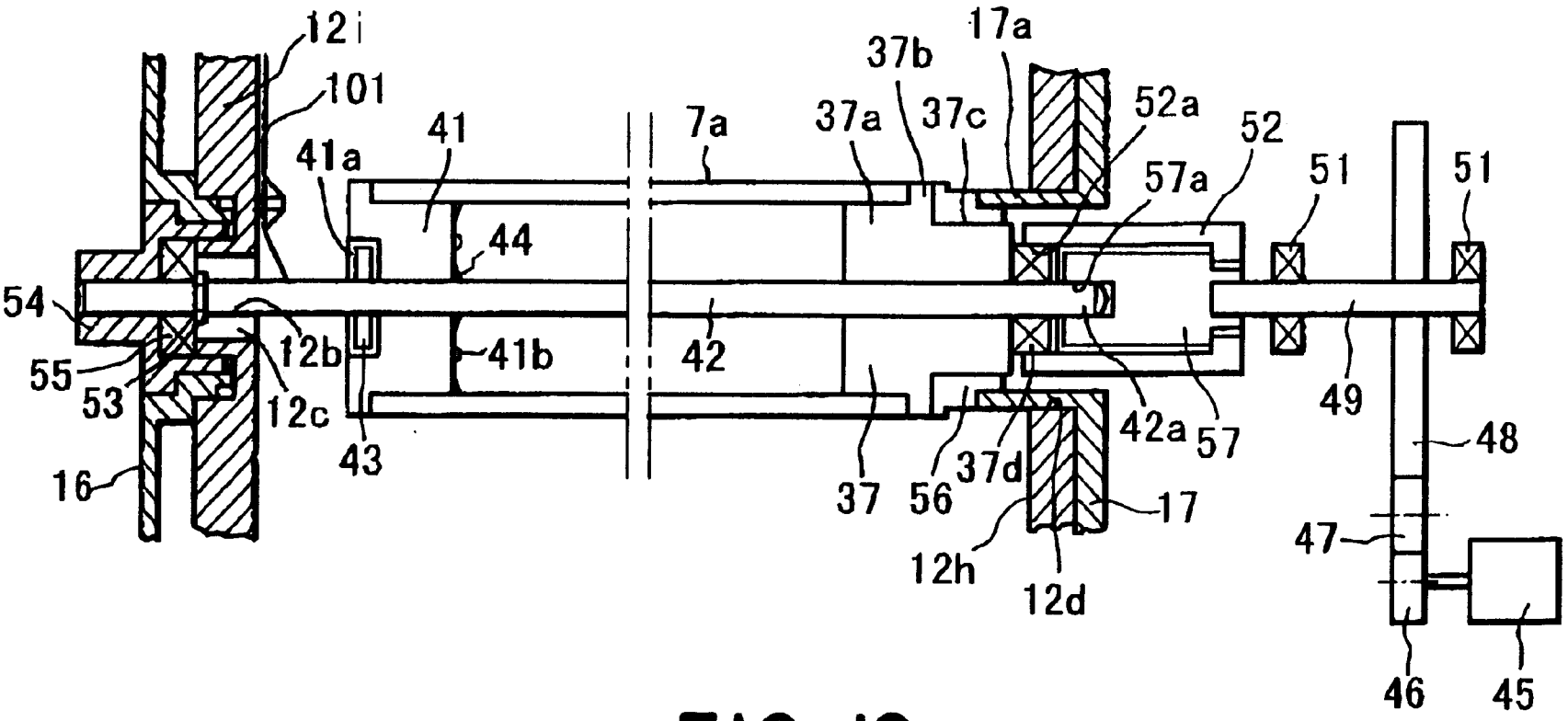
FIG. 19 is a longitudinal sectional view of a supporting structure and a driving device for an electrophotographic photosensitive drum.

FIG. 19 illustrates a support method and a driving method for the photosensitive drum 7. The photosensitive drum 7 includes a drum cylinder 7*a* of aluminum having an outer photosensitive layer, a driving side drum flange 37 crimped to one longitudinal end thereof, and a non- driving side drum flange 41 crimped to the other longitudinal end thereof. One end of the drum shaft 42 provided at the center of the drum flange 37, 41 is penetrated through a drum shaft support hole 12*b* formed in the end plate portion 121 of the developing frame 12. A pin 43 press-fitted hole having a diameter substantially equal to the diameter of the drum shaft 42 is snugly fitted to a groove 41*a* extended in a radial direction from the center hole of the drum flange 41 at the non-driving side. An electroconductive spring 44 for electric connection between the drum shaft 42 and the drum cylinder 7*a* is fixed to the end surface in the drum flange 41 at the non-driving side. The fixing method is such that an electroconductive spring 44 is engaged to a dowel 41*b* provided in the drum flange 41, and the dowel 41*b* is welded. One end of the electroconductive spring 44 is press-contacted by its elasticity to the inner surface of the drum cylinder 7*a*, and the other end is press-contacted by its elasticity to the drum shaft 42.

One end of the drum grounding contact 101 mounted to the end plate portion 121 of the developing frame 12 is contacted to the drum shaft 42 by elasticity thereof. The drum grounding contact 101 is disposed in the developing frame 12, and the other end is exposed to the outside of the process cartridge B to provide an outer contact.

The groove 12*c* extended in the radial direction from the drum shaft support hole 12*b* at the end plate portion 121 permits the pin 43 to penetrate therethrough in the axial direction.

In the driving side drum flange 37, there are provided in the order named a mounting portion 37*a* for mounting to the drum cylinder 7*a*, a flange 37*b* contacted to the drum cylinder 7*a* end, a journal portion 37*c* extended from the flange 37*b* and having a diameter smaller than that, and a male coupling projection 37*d* projected in the axial direction from the center portion of the end surface of the journal portion 37*c*. The driving side drum flange 37 is an integral mold of plastic resin material.

The journal portion 37*c* is rotatably engaged with a support portion 17*a* integral with the rear cover 17 engaged into the hole 12*d* of the end plate portion 12*h* of the developing frame 12, through a collar 56.

Figure 20:
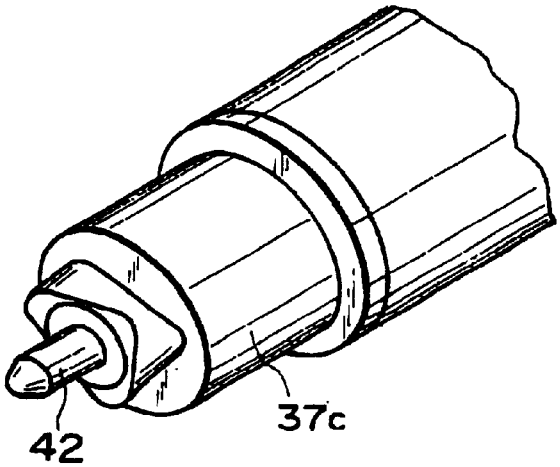
FIG. 20 is a perspective view of a driving-side drum flange.

The male coupling projection 37*d*, as shown in FIG. 20, is in the form of a twisted equilateral triangular prism concentric with the drum shaft 42. The circumscribed circle diameter of the triangular prism has a diameter that is smaller than that of the journal portion 37*c*.

The driving device of the main assembly 14 of the apparatus comprises a motor 45 fixed thereto, a pinion 46 fixed to a motor shaft of the motor 45, a large gear 48, a middle gear 47 rotatably supported and in meshing engagement with the pinion 46 and the large gear 48, a large gear shaft 49 fixed to the large gear 48 and having a centering portion 57 fixed to the end thereof, a bearing 51 for the large gear shaft 49, and a female coupling shaft 52. The middle gear 47 may be replaced with two or more gears.

The bearing 51 supports the large gear shaft 49, preventing the thrust movement thereof.

The female coupling recess 52*a* is provided with a hole having a twisted shape complimentary with the male coupling projection 37*d*, and is engaged therewith by axial movement thereof. When the male coupling projection 37*d* and the female coupling recess 52*a* are engaged with each other, the apex lines of the twisted equilateral triangular prism of the male coupling projection 37*d* are contacted to the surfaces of the female coupling recess 52*a* by which the male coupling projection 37*d* is centered with the female coupling recess 52*a* so that rotational centers are correctly aligned. The centering portion 57 and the female coupling recess 52 are loosely fitted to permit movement of very small amount in the circumferential direction. The female coupling shaft 52 is correctly positioned when it is moved most to the process cartridge B, and it is retractable against the spring force.

A supporting portion of the drum shaft 42 at the non-driving side is structured to prevent the drum shaft 42 from moving toward the non-driving portion side. As shown in the figure, a retaining ring 53 is engaged with the drum shaft 42. The bearing 55 is accommodated in a bearing case 54 fixed to the front cover 16 fixed to the end plate portion 121 of the developing frame 12 and is engaged with the drum shaft 42. The bearing 55 is prevented from moving toward the non-driving side of the drum shaft 42 by contacting the retaining ring 53 and by contacting the bearing case 54 to the inner and outer race ring ends at the axially opposite end. On the other hand, the movement of the photosensitive drum 7 toward the driving side is limited through the drum flange 37 and the collar 56 engaged in the journal portion 37*c*. With this structure, the distance between the support portion 17*a* and the bearing 55 is larger than the distance between the retaining ring 53 and the support portion 17*a* for the color 56 and the face opposed to the bearing 55 to permit limited movement of the photosensitive drum 7 in the axial direction.

With this structure of the driving device, when the process cartridge B is mounted to the main assembly 14 of the image forming apparatus, the cartridge frame (the developing frame 12, the front cover 16 and the cover 17) is positioned correctly relative to the main assembly 14 of the apparatus in the longitudinal direction. Simultaneously, the prior end portion 42*a* of the drum shaft 42 is engaged into the center hole 57*a* of the centering portion 57, and the male coupling projection 37*d* is engaged into the female coupling recess 52*a*. When the motor 45 is rotated, the pinion 46, the middle gear 47 and the large gear 48 are rotated so that female coupling shaft 52 is rotated through the large gear shaft 49 and the centering portion 57. By the rotation the male coupling projection 37*d* and the female coupling recess 52*a* are such that drum flange 87 and the female coupling shaft 52 are attracted toward each other because of the twisting thereof, by which the end of the male coupling projecting 37*d* contacts the bottom surface of the female coupling recess 52*a*. Therefore, the axial position of the photosensitive drum 7 is determined with respect to the female coupling shaft 52, which is positioned correctly.

If the male coupling projection 37*d* is not engaged with the female coupling recess 52*a*, even when the process cartridge B is mounted to the main assembly 14 of the apparatus, the end surface of the male coupling projection 37*d* pushes the edge of the recess 52*a* of the female coupling shaft 52 to retract the female coupling shaft 52 toward the process cartridge B against the spring force. Therefore, during a pre-rotation of the photosensitive drum 7 after the mounting of the process cartridge B, the male coupling projection 37*d* is brought into engagement with the recess 52*a* immediately, when the phase alignment is reached therebetween. In an alternative structure, the end surface of the male coupling projection 37*d* does not abut the bottom of the female coupling recess 52*a*, and the flange 37*b* of the drum flange 37 is attracted to the support portion 17*a* of the rear cover 17 by way of the collar 56 by the attracting force provided by the coupling.

In the foregoing embodiments, the process cartridge has been described as containing the developing means, the charging means capable of collecting the toner and the photosensitive drum, the supporting structure for the photosensitive drum relative to the cartridge frame and the structure for the engagement and disengagement between the driving force receiving portion of the photosensitive drum and the driver material of the main assembly of the image forming apparatus is generally usable with other process cartridges.

The process cartridge integrally contains an electrophotographic photosensitive drum, and charging means, developing means or cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Furthermore, the process cartridge may contain at least the electrophotographic photosensitive drum and the developing means.

(Driving of the Developing Roller)

Figure 13:
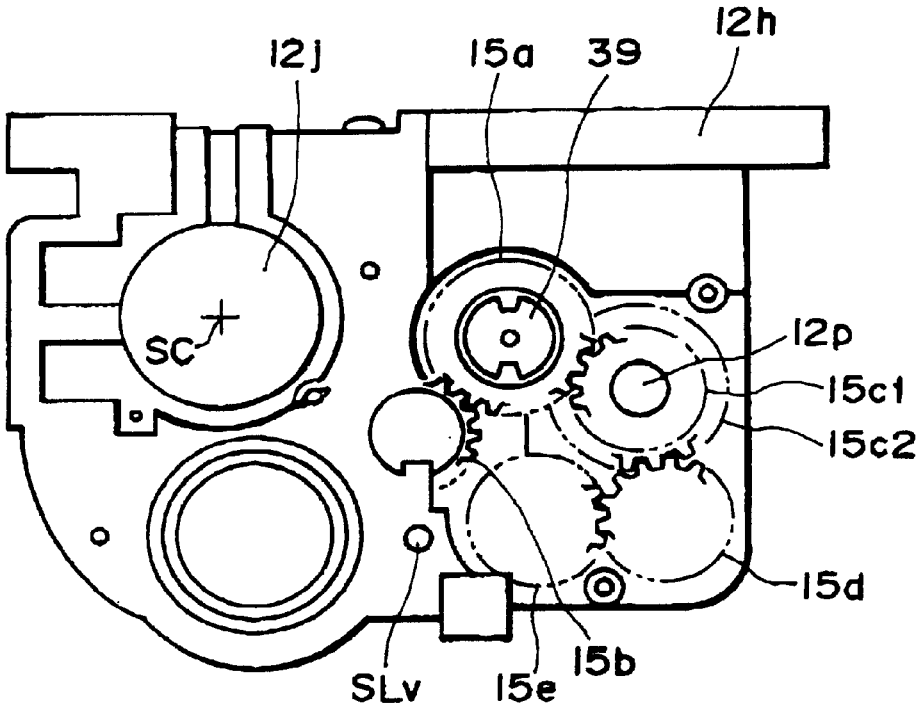
FIG. 13 is a rear view of a developing unit without a rear cover.
Figure 21:
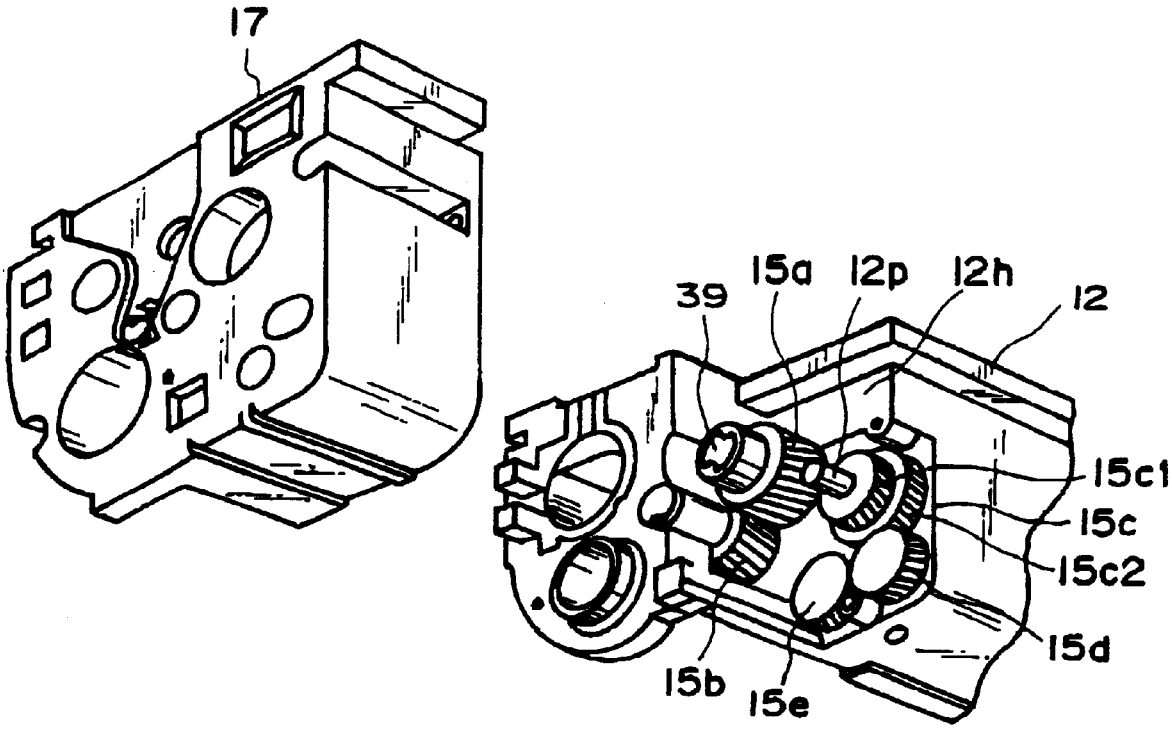
FIG. 21 is a perspective view of a process cartridge without the rear cover as seen inclinedly from a rear bottom side.

To the developing roller 10*d*, as shown in FIG. 17, a developing roller gear 15*b* is fixed at a position longitudinally outside of the journal portion 10*d*1. The developing roller gear 15*b*, as shown in FIGS. 7, 13, and 21, is in meshing engagement with the developing device driving gear 15*a*. The developing device driving gear 15*a* is integrally molded with a developing device coupling 89, which is a driving force receiving member for the rotation of the developing device, and is provided with a cylindrical hole at the center of the rear side of the developing device coupling 39. An unshown shaft portion extended longitudinally from the end plate portion 12*h* of the developing frame 12 is rotatably engaged with the cylindrical hole on the developing device coupling 39 provided with a developing device driving gear 15*a*.

The developing device driving gear 15*a* is in meshing engagement with the small gear 15*c*1 of a dual gear 15*c* having two gears arranged axially. The gear 15*c* is rotatably engaged with a shaft portion 12*p* integral with the end plate portion 12*h* and extended in the longitudinal direction. The large gear 15*c*2 of the dual gear 15*c* is in meshing engagement with a stirring gear 15*d* interrelated with the rear shaft end of the stirring screw 10*g* as shown in FIG. 2. The stirring gear 15*d* is in meshing engagement with the stirring gear 15*c* interrelated with the rear shaft end of the stirring screw 10*h*. The stirring gears 15*d*, 15*c* have an unshown journal in the middle portion in the axial direction, and unshown integral connecting potions for connecting with the stirring screws 10*g* and, 10*h*, at the axial ends thereof. The journal is rotatably engaged with and supported by an unshown bearing hole of the end plate portion 12*h* of the developing frame 12, and the interconnection portions are engaged with the rear ends of the stirring screws 10*h* and 10*g* to drive the stirring screws 10*g* and 10*h*.

Figure 14:
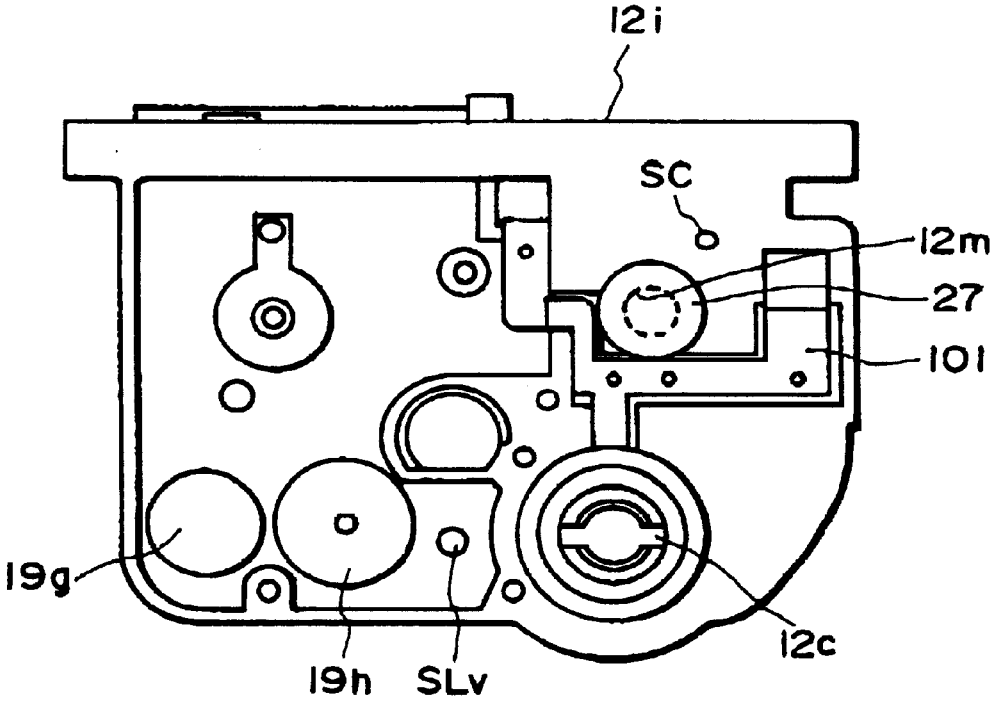
FIG. 14 is a front view of a developing unit without a front cover.
Figure 15:
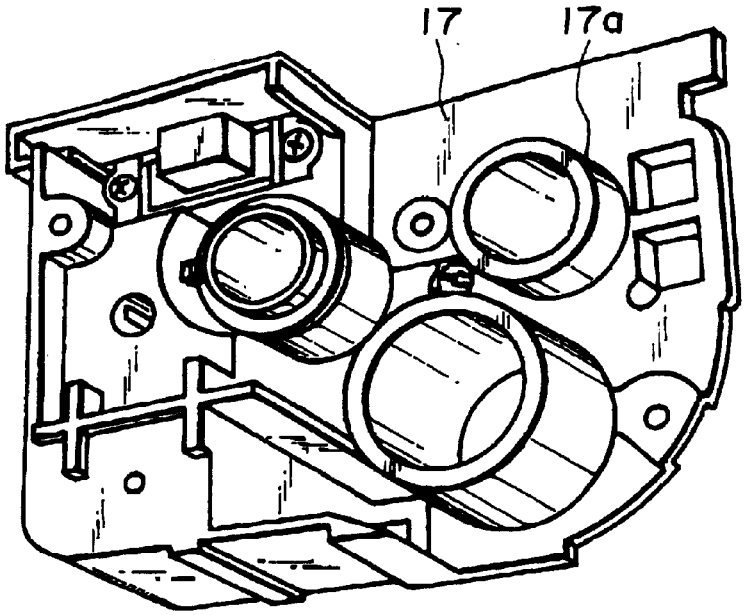
FIG. 15 is a perspective view of an inside of a rear cover.
Figure 16:
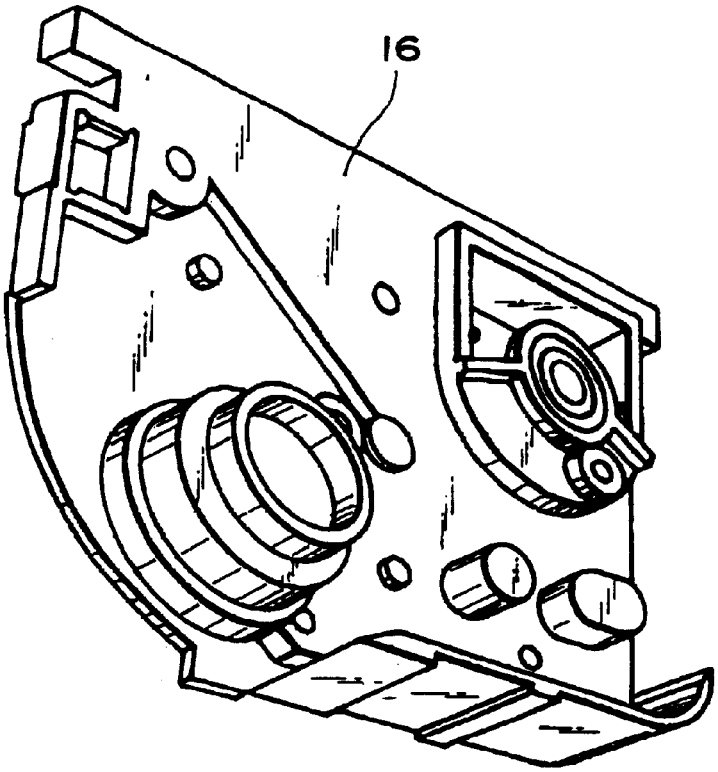
FIG. 16 is a perspective view of an inside of a front cover.

The front shaft end of the stirring screws 10*gm*, 10*h* is provided with a center hole, and as shown in FIG. 14, it is press-fitted with the longitudinal hole of the end plate portion 121 opposite from the end plate portion 12*h* of the developing frame 12, and the supporting shafts 19*g*, 19*h* having the end projected inwardly of the developing frame 12 are rotatably engaged with the center hole of the shaft end.

When the driving force is transmitted from the main assembly 14 side of the apparatus after the process cartridge B is mounted to the main assembly 14 of the apparatus, the developing device coupling 39 is rotated. The developing device driving gear 15*a*, which is integral with the developing device coupling 39, rotates the developing roller gear 15*b* by which the developing roller 10*d* is rotated. The developing device driving gear 15*a* drives the stirring gear 15*d* by way of the dual gear 15*c*, and the stirring gear 15*d* transmits the rotation to the stirring gear 15C. Then, the stirring screws 10*g*, 10*h* are rotated to circulate and stir the toner.

The developing roller 10*d* rotates the photosensitive drum 7 in the same direction. Therefore, the peripheral surfaces of the developing roller 10*d* and the photosensitive drum 7 move in the directions opposite from each other at the positions where the peripheral surfaces are faced to each other (developing zone). The rotatable spacer rollers 10J (FIG. 17) for the developing roller 10*d* provided at the opposite ends rotate with the photosensitive drum 7 in the opposite rotational direction as compared with the rotation of the developing roller 10*d*.

The gears 15*a*, 15*b*, 15*c*, 15*d*, 15C, as shown in FIG. 21, are covered by a rear cover 17 fixed to be abutted to the end plate portion 12*h* of the developing frame 12.

(Driving of Charging Roller)

Figure 23:
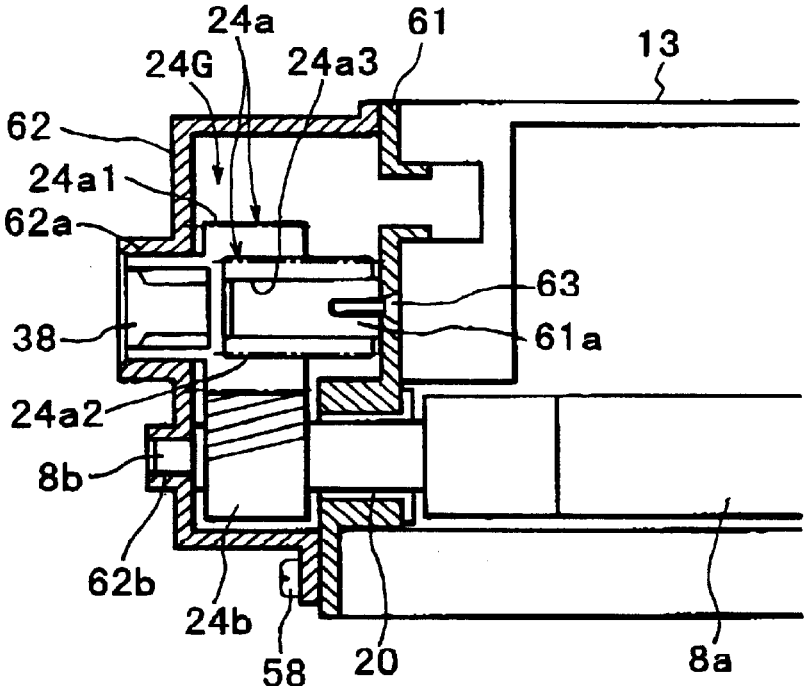
FIG. 23 is a sectional view taken along a line A-B-C-D-E.
Figure 24:
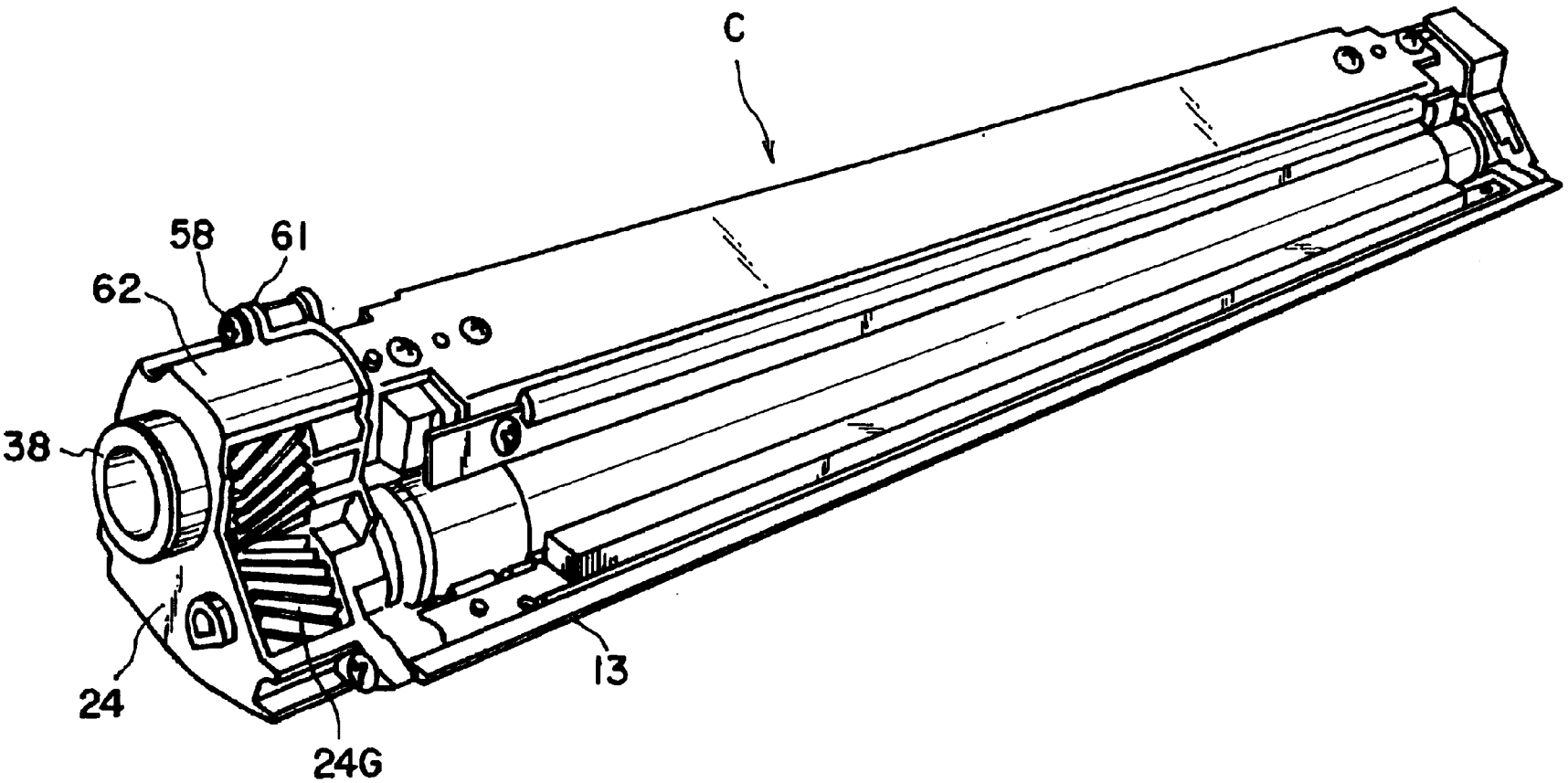
FIG. 24 is a perspective view of a charging unit.

As shown in FIGS. 11, 23, and 24, the gear unit 24 fixed to the rear longitudinal end of the charging unit C comprising a gear case having two divisible portions 61 and 62 accommodates a gear array 24G.

The gear cases 61 and 62 are divisible into two longitudinal portions, and the gear case 61 abuts the rear longitudinal end of the charging frame 13 and is secured together to the charging frame 13.

Figure 22:
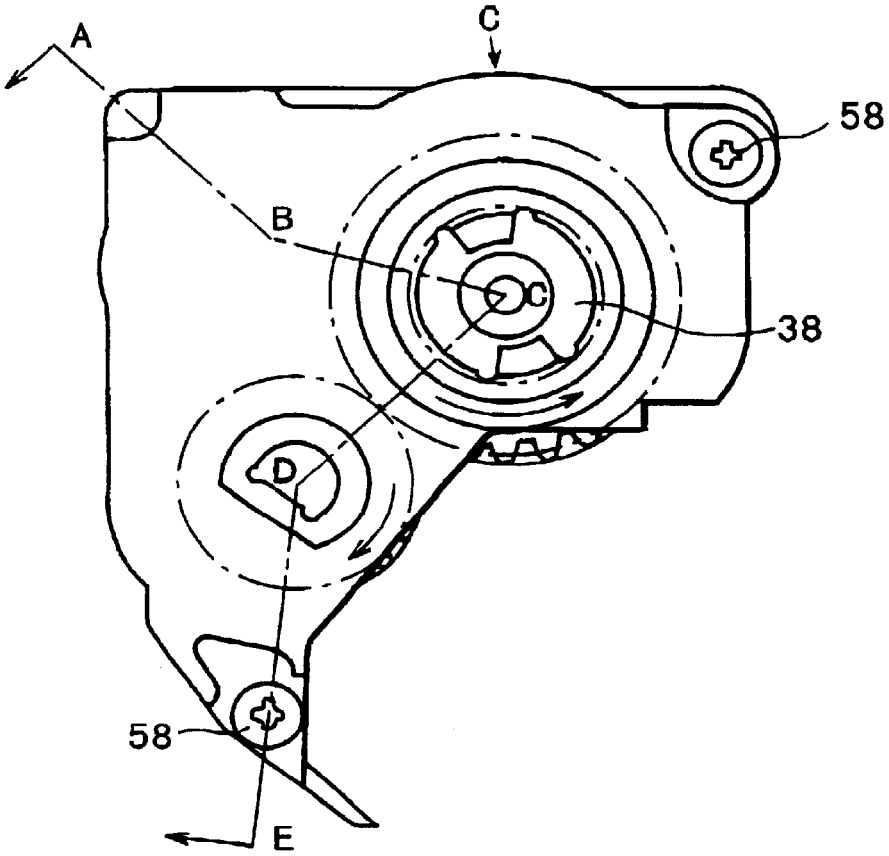
FIG. 22 is a front view of a charging unit.

FIG. 22 is a front view of the charging unit C as seen in the longitudinal direction at the rear end. FIG. 23 is a cross-section of the device of FIG. 22 taken along a line A-B-C-D-E. The charger coupling 38 is provided with an integral dual gear 24*a*. The center hole 24*a*3 of the dual gear 24*a* is fixed to the gear case 61 by small screw 63 and is rotatably engaged with the supporting shaft 61*a* projected in the longitudinal direction. The supporting shaft 61*a* may be integrally molded with the gear case 61. The charging roller 8*a* is rotatably supported in the rear side charging roller bearing 20 after it is engaged with the mounting portion 13*f* of the charging frame 13.

The large gear 24*a*1 of the dual gear 24*a* is engaged with the charging roller gear 24*b* fixed to one end of the charging roller 8*a*. The hole 62 of the gear case 62 supports one end of the magnet 8*b*. The large gear 24*a*1 and the small gear 24*a*2 are fixed together. They may be integrally molded.

(Driving System for Process Cartridge)

The main assembly 14 of the apparatus is provided with the driving device of the process cartridge B. The driving device is in the form of a driving unit having three couplings for engagement with the male coupling projection 37*d*, the charger coupling 38 and the developing device coupling 39, respectively. The driving device for driving the photosensitive drum 7 shown in FIG. 19 is different from this embodiment, and therefore, the reference numerals used in FIG. 19 are not used to this embodiment.

The three couplings are driven by three independent driving sources. Therefore, the photosensitive drum 7, the charging roller 8*a* and the developing roller 10*d* are free of influence of the driving system. This is advantageous particularly in the quick start-up of the rotation of the photosensitive drum 7.

In the rear side of the cartridge mounting portion for each of the process cartridges B(BY, BM, BC, BB) of the main assembly 14 of the apparatus, there is provided the driving unit, and then the process cartridge B is inserted in the longitudinal direction (the axial direction of the photosensitive drum 7) and is mounted to the cartridge mounting portion, the coupling (driving force receiving member) for the process cartridge B is brought into engagement with the coupling (driving transmission member) of the driving unit.

Figure 25:
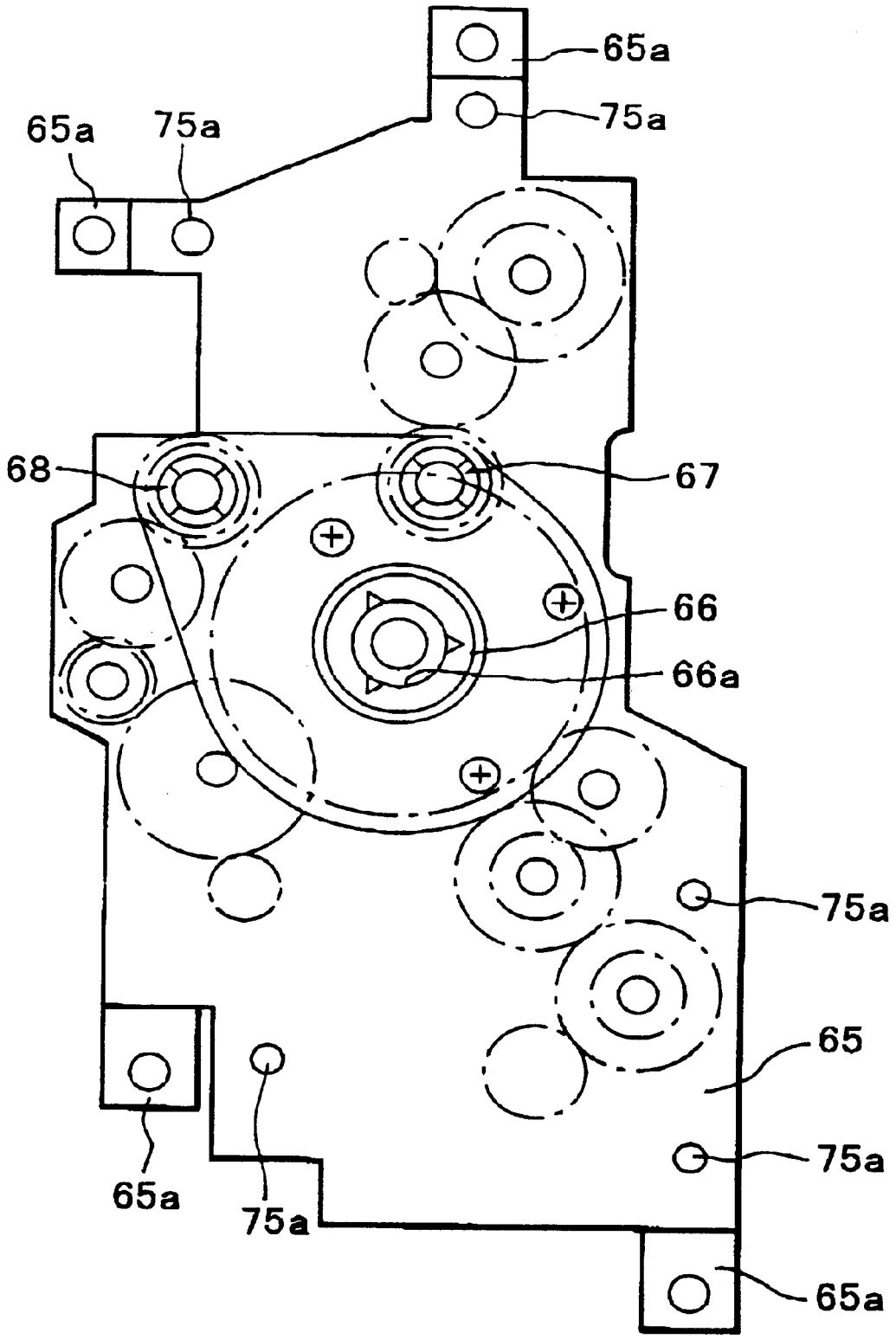
FIG. 25 is a front view of a main assembly side driving unit.
Figure 26:
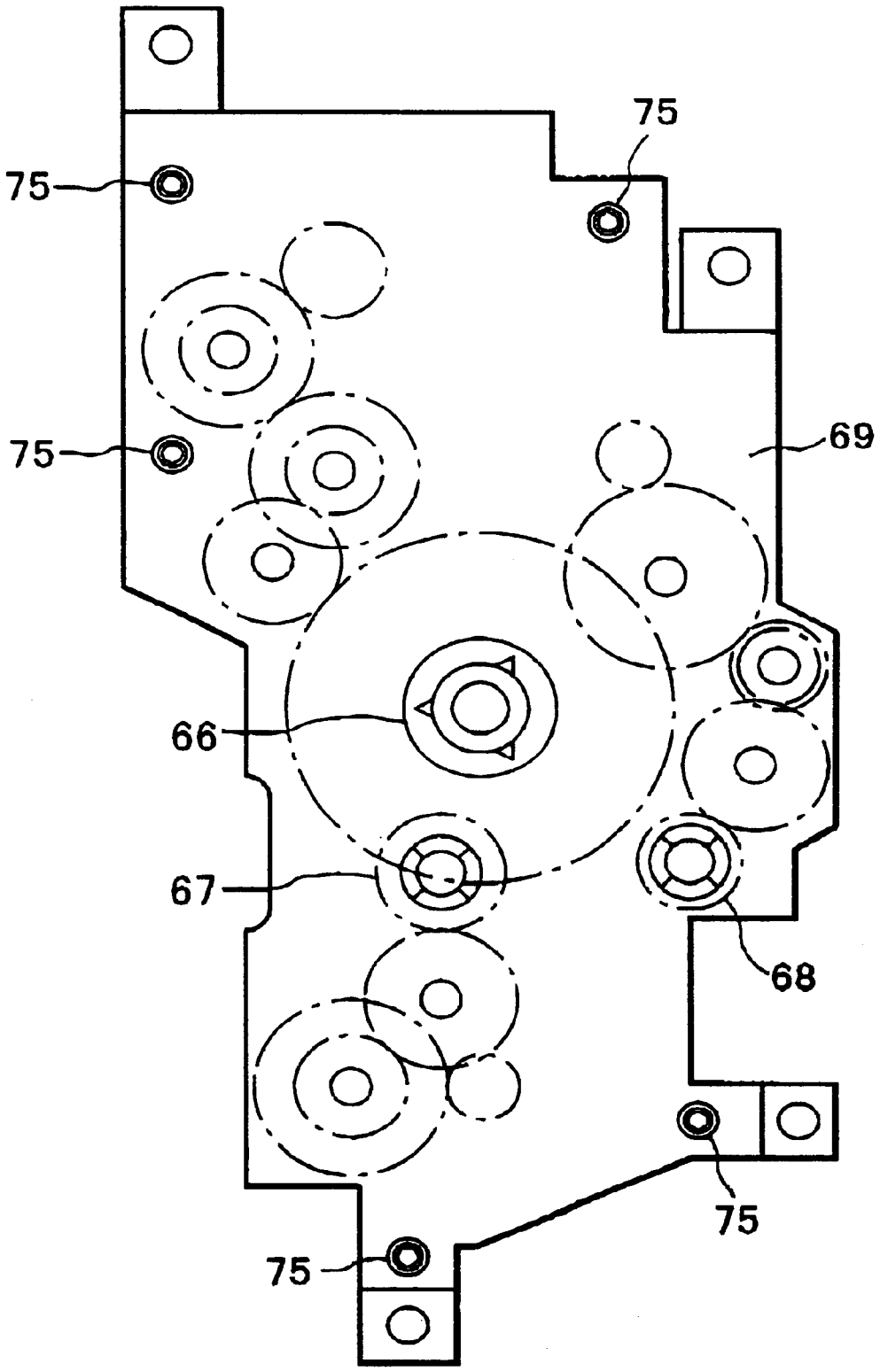
FIG. 26 is a front view of the same device as of FIG. 25 but without the front plate.
Figure 27:
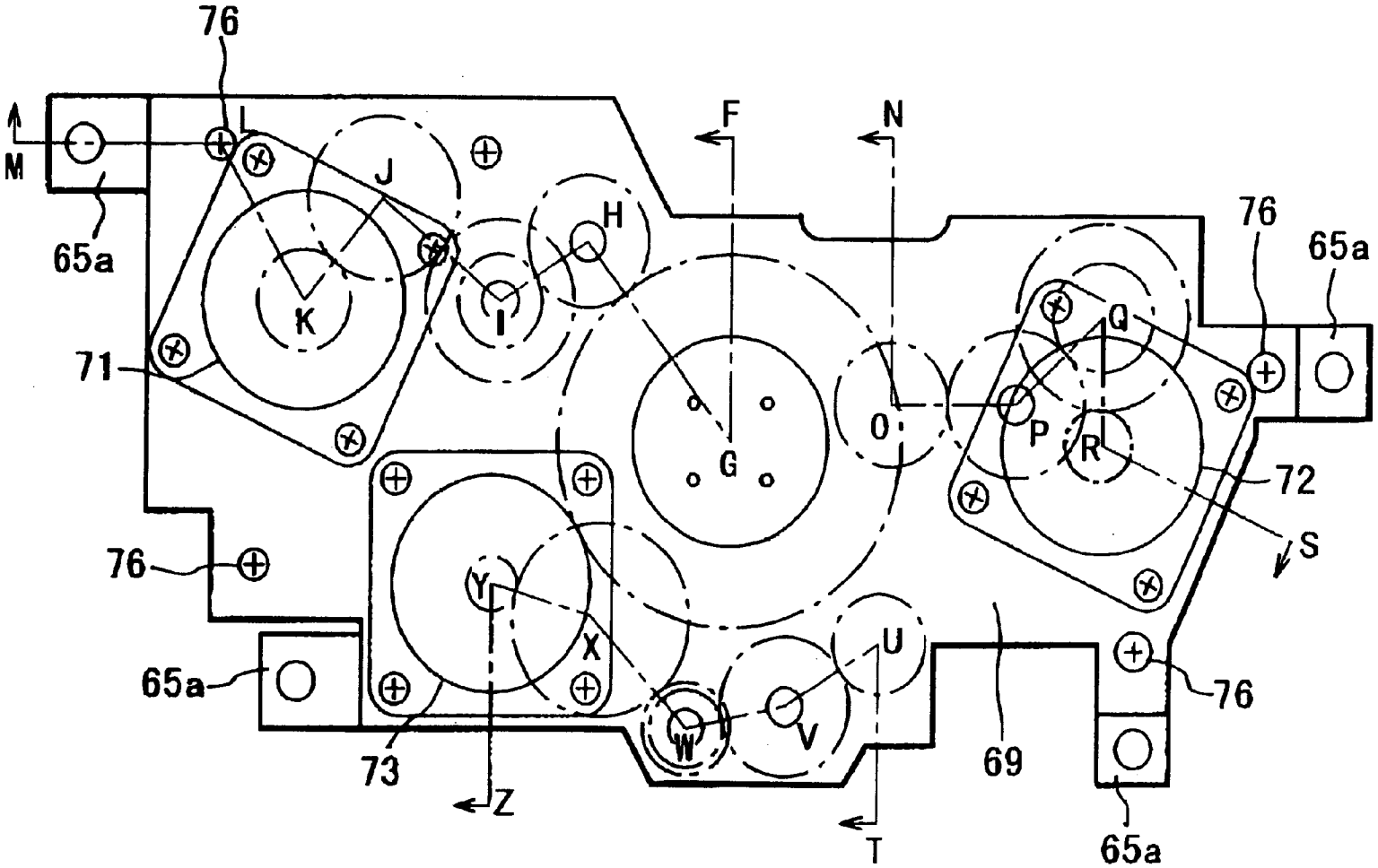
FIG. 27 is a rear view of a main assembly side driving unit.
Figure 28:
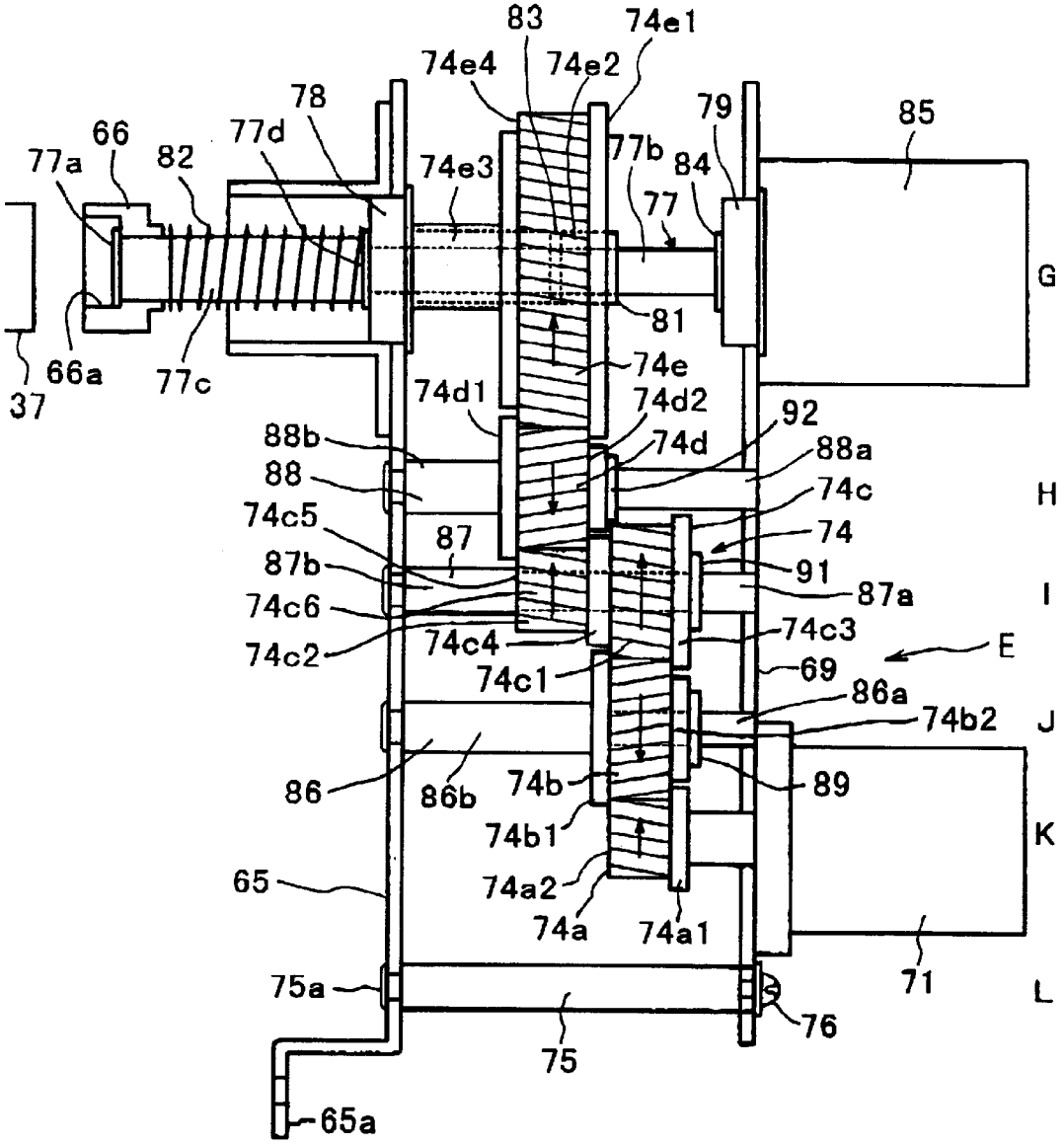
FIG. 28 is a sectional view of the device shown in FIG. 27 taken along a line F-G-H-I-J-K-L-M.
Figure 29:
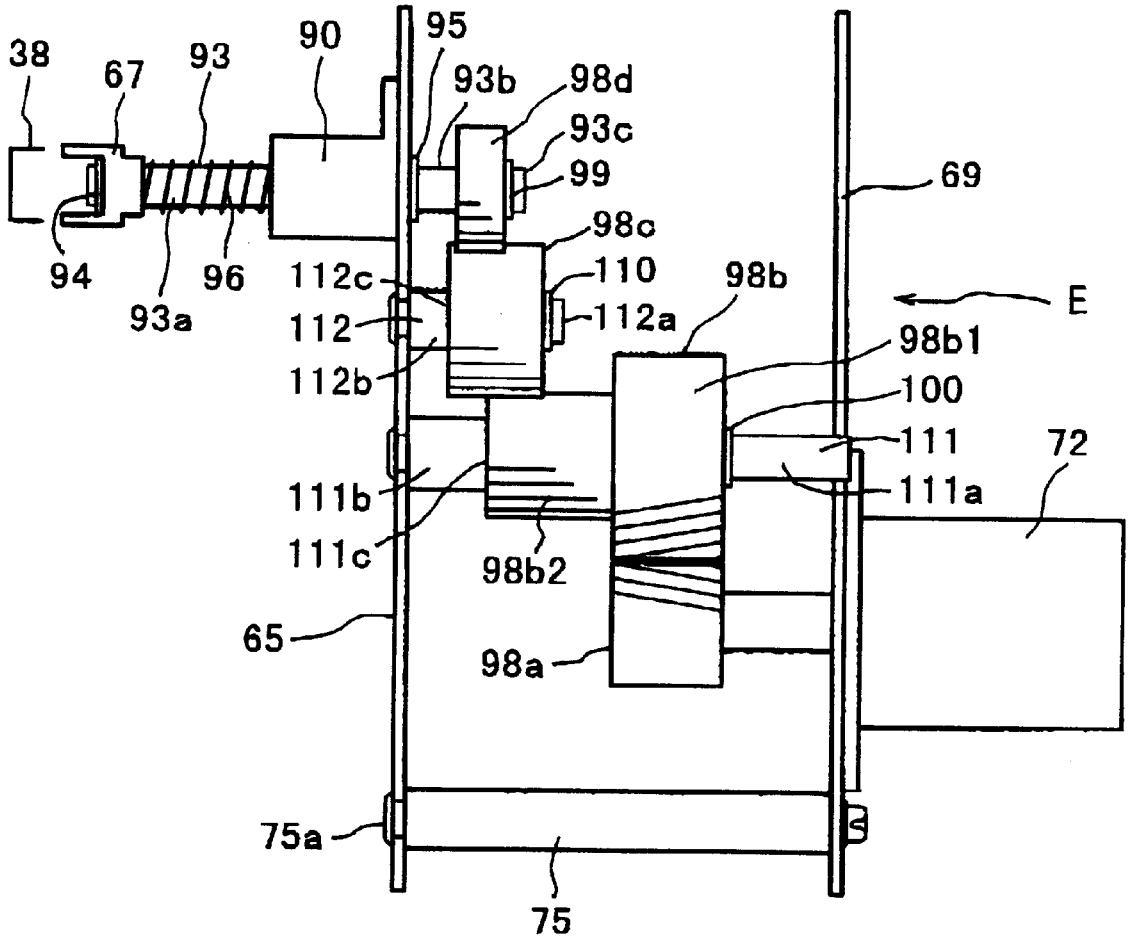
FIG. 29 is a sectional view of the device shown in FIG. 27 taken along a line N-O-P-Q-R-S.
Figure 30:
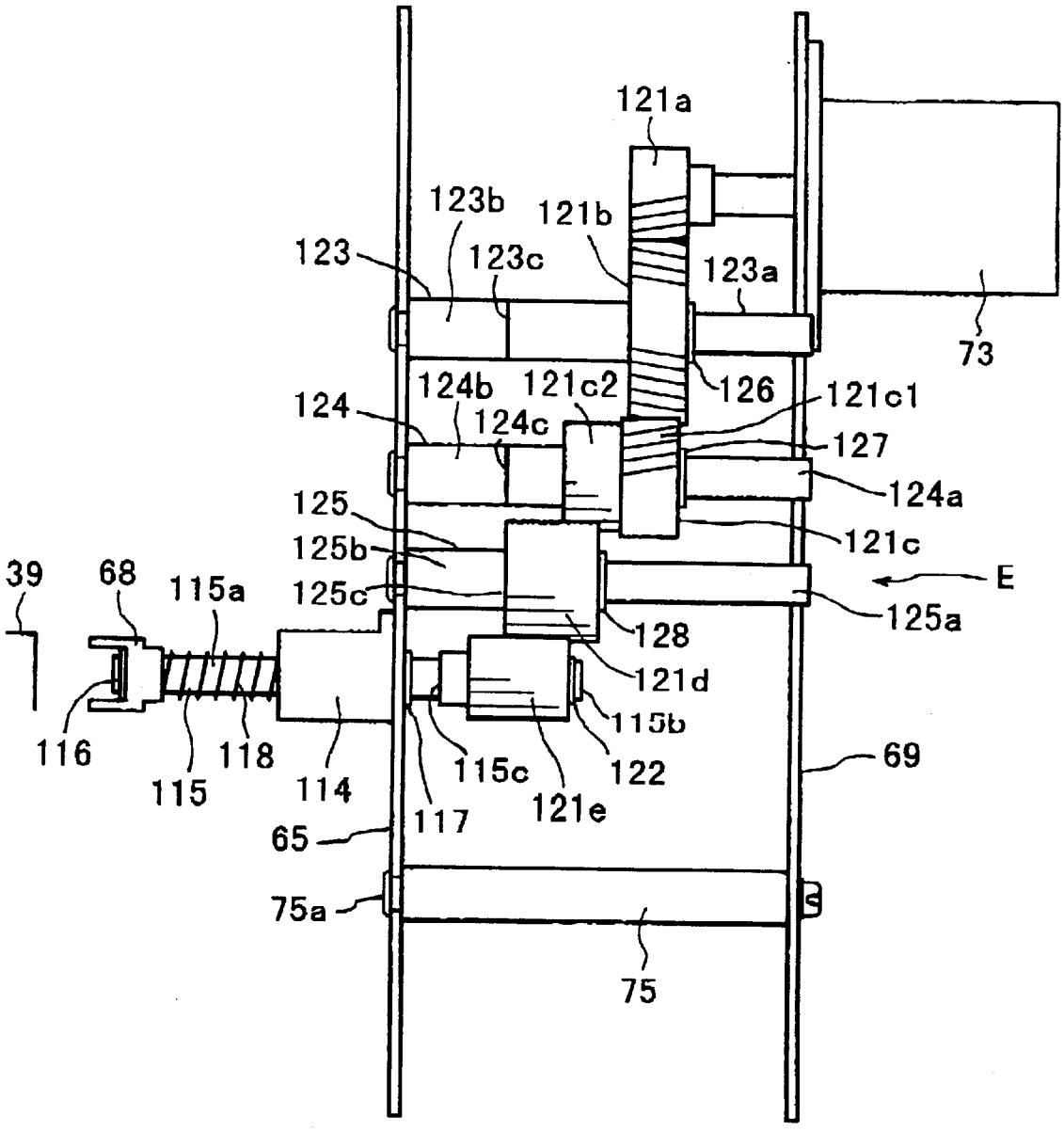
FIG. 30 is a sectional view of the device shown in FIG. 27 taken along a line T-U-W-X-Y-Z.

FIG. 25 is a front view of the driving unit, and FIG. 26 is a front view of the device of FIG. 25 without the front point, and FIG. 27 is a rear view of the driving unit. In FIG. 25 to FIG. 27, the gear is represented by a pitch circle. FIG. 28 is a sectional view of the device shown in FIG. 27 taken along a line F-G-H-I-J-K-L-M. FIG. 29 is a sectional view of the device shown in FIG. 27 taken along a line P-Q-R-S. FIG. 30 is a sectional view of the device shown in FIG. 27 taken along a line T-U-W-X-Y-Z.

As shown in FIG. 25, in the front side of the driving unit, there are provided a driving side coupling 66 having a female coupling recess 66*a* for disengageable engagement with the male coupling projection 37*d* of the process cartridge B at a position away from the front plate 65 in the inserting direction of the process cartridge B (front side of the sheet of the drawing), a driving side charger driving coupling 67 for disengageable engagement with the charger coupling 38 of the process cartridge B, and a driving site developing device coupling 68 for disengageable engagement with the developing device coupling 39 of the process cartridge B.

As shown in FIG. 27, a motor 71 for driving the photosensitive drum 7, a motor 72 for driving the charging roller 8*a* and a motor 73 for driving the developing roller 10*d* are fixed to the outside of the rear plate 69. The motor shafts of the motors 71, 72, 73 are projected between the front plate 65 and the rear plate 69. The motor 71 for driving the photosensitive drum 7 is a servomotor, and the motor shaft is projected rearward, too.

The front plate 65 and the rear flat plate 69 are connected by a plurality of stays 75 provided therebetween to make them extend parallel to each other. As shown in FIG. 28 to FIG. 30, each of the stays 75 is crimped to the front plate 65 at one end thereof, and abuts the inside of the rear plate 69 at the other end, and the other end is secured to the rear plate 69 by a study through a hole formed in the rear plate 69. The front plate 65 is provided with a plurality of, four in this embodiment, mounting portions 65*a* for mounting the driving unit E to the main assembly 14 of the apparatus in one vertical plane offset frontward from the front plate 65, and the driving units E are mounted to the main assembly 14 of the apparatus by small screws (unshown).

As shown in FIG. 28, a gear train 74 is provided between the driving side coupling 66 for the photosensitive drum.

(Driving Device for Photosensitive Drum)

As shown in FIG. 28, the coupling shaft 77 is supported by a bearing 78 engaged with the front plate 65 and a bearing 79 engaged with the rear plate 69, a D-shaped shaft portion 77*c* having a D-shape cross-section and having a diameter smaller than the flange 77*a* at the front end is engaged with a driving side coupling 66 for axial movement. Between the bearing 78 having the flange and the coupling 66, a coil spring 82 is compressed around the D cut portion 77*c*, and the coupling 66 is pressed against the flange 77*a* of the Dcut 77*c*. The shaft portion 77*b* supported by the bearing 78 has the same diameter in the rear portion, and has a diameter smaller than that of the Dcut portion 77*a*. The stepped portion 77*d* providing the small diameter portion abuts later an inner ring order bearing 78, and a boss 74C3 of the gear train 74 contacts the bearing 78. The large gear 74C is prevented from moving in the axial direction by the retaining ring 81 contacting the side opposite from the bearing 78. The ring 81 is engaged in the groove extending in the circumferential direction of the shaft portion 77*b*. The key groove 74C2 formed in the large gear 74C is engaged with a pin 83 extending across the shaft portion 78*e*1 in the radial direction, and the large gear 74C is fixed so that it is rotated together with the coupling shaft 77. The bearing 79 with the flange engaged with the rear plate 69 is prevented from axial movement by a retaining ring 84 engaged in the groove extended in the circumferential direction of the shaft portion 77*b*.

The coupling shaft 77 is extended rearward from the rear plate 69. There is provided a rotational-angle detecting means for the coupling shaft 77, such as an encoder 85, to control the photosensitive drum 7.

A gear 74*b* in meshing engagement with the pinion gear 74*a*, fixed to the output shaft portion of the motor 71, is engaged with the large gear 74*c*1 of the dual gear 74*c*. A gear 74*d* is in meshing engagement with the small gear 74*c*2 of the dual gear 74*c* is engaged with the large gear 74C. The middle gears 74*b*, 74*c*, 74*d* are rotatably engaged with the reduced-diameter portions 86*a*, 87*a*, 88*a* of the fixed shaft 86, 87, 88, respectively, and are limited, in their axial movement with a short movable distance, by the stepped portions formed between the large diameter portions 86*b*, 87*b*, 88*b* and the small diameter portions 86*a*, 87*a*, 88*a* and retaining rings 89, 91, 92 engaged in the circumferential grooves formed in the small diameter portions 86*a*, 86*b*, 86*c*. One side ends of the fixed shafts 86, 87, 88 are crimped into the holes of the front plate 65, and the other side ends are engaged into the holes of the rear plate 69.

The gears 74*a*–74C are helical gears, and the pinion gear 74*a* is twisted in the clockwise direction, and the large gear 74C is twisted in the clockwise direction.

As shown in FIG. 28, the gears 74*a*–74C are provided with flanges 74*a*1, 74*b*1, 74*c*3, 74*c*4, 74*d*1, 74*e*1, respectively. The side surfaces of the flanges contact the side surfaces of the gears with which they are engaged. The flanges of the gears engaged with each other are provided on the opposite sides of the gears.

Each of the gears is rotated in such a direction that peripheral surfaces are moved in the direction indicated by the arrow. As shown in FIG. 1, the rotational direction is such that photosensitive drum 7 is rotated in the counter-clockwise direction.

When the motor 71 is rotated, the gear 74*b* in meshing engagement with the gear 74*a* of the motor shaft receives a thrust force in the rightward direction in FIG. 28. The thrust force is received by the flange 74*a*1 integral with the pinion gear 74*a* and/or by the flange 74G3 of the large gear 74*c*1 with sliding rotation. It is received by abutment between the flange 74*b*1 and the side surface 74*a*2 of the pinion gear 74*a* of the motor shaft. Furthermore, it is received by abutment between the flange 74*b*1 and the side surface 74*c*6 of the large gear 74*c*1. The thrust may be received by at least one of the above-described portions, but is may be received by only one of the portions, in view of the manufacturing error.

The large gear 74*c*1, and small gear 74*c*2 have the same twisting direction, and they receive thrust in the leftward direction in FIG. 28. The thrust force is received by at least one of the abutment of the flange 74*c*3 of the large gear 74*c*1 of the dual gear 74*c* to the side surface 74*b*2 of the gear 74*b*, the abutment of the flange 74*c*4 of the small gear 74*c*2 to the side surface 74*d*2 of the gear 74*d*, the abutment of the side surface 74*c*5 of the small gear 74*c*2 to the flange 74*d*1 of the gear 74*d* and the abutment of the side surface 74*c*7 of the large gear 74*c*1 to the flange 74*b*1 of the gear 74*b*.

The thrust of the gear 74*d* is applied in the rightward direction in FIG. 28, and is received by at least one of the abutment between the flange 74*d*1 and the side surface 74G5 of the small gear 74*c*2 of the dual gear 74*c*, the abutment between the side surface 74*d*2 of the gear 74*d* and the flange 74G4 of the small gear 74*c*2 of the dual gear 74*c*, the abutment between the side surface 74*d*2 of the gear 74*d* and the flange 74*e*1 of the large gear 74C and the abutment between the flange 74*d*1 and the side surface 74C4 of the large gear 74C. As described in the foregoing, the large gear 74C is mounted to the coupling shaft 77 such that it does not move in the axial direction.

The axial positions of the middle gears 74*b*, 74*c*, 74*d* in the axial direction are determined by stepped portion formed between the large diameter portions 86*b*, 87*b*, 88*b* of the fixed shafts 86, 87, 88, and the small diameter portions 86*a*, 87*a*, 88*a*, and the retaining rings 89, 91, 92 so that thrust movements of the middle gear 74*b*, 74*d* are limited by the rings 89, 92, and the thrust movement of the middle gear 74*c* is limited by the stepped portion of the fixed shaft 87.

Therefore, the axial positions of the pinion gear 74*a* of the motor shaft and the large gear 74*c* of the coupling shaft 77 are determined by the supporting shafts, respectively. The axial positions of the middle gears 74*b*, 74*c*, 74*d*, the large gear 74C of the coupling shaft 77 and the pinion gear 74*a* of the motor shaft, are determined by the abutments between the flanges and the side surfaces of the gears, so that limited movements of the middle gears 74*b*, 74*c*, 74*d* are permitted.

(Driving Device for Charging Roller)

FIG. 29 shows a charger driving device provided with a coupling engageable with the charger coupling 38. Coaxially with the charger coupling 38 shown in FIG. 24, a charger driving side coupling 67 is provided engageably with the charger coupling 38. The couplings are in the form of a claw clutch wherein one has two projected portions and the other has two complementary recesses, which are engaged with each other to transmit the rotating force. The charger driving side coupling 67 is supported for rotation by an unshown bearing engaged in the bracket 90 fixed to the front plate 65, and is engaged with an axially movable coupling shaft 93 and is axially movable. The shaft portion 93*a* of the coupling shaft 93 on which coupling 67 is mounted has a D-shape cross-section and is engaged into a D-shaped hole of the coupling 67 so that coupling 67 and the coupling shaft 93 are rotated integrally. In grooves extending in the circumferential direction, on the front end of the coupling shaft 93 and the back side of the front plate 65, retaining rings 94, 95 are fitted. Between the coupling 67 and the bracket 90, a compression coil spring 96 is compressed and fitted around the coupling shaft 93.

A pinion gear 98*a* fixed to the motor shaft of the motor 72 fixed to the rear plate 69 is in meshing engagement with the large gear 98*b*1 of the dual gear 98*b*, and the gear 98*c* in meshing engagement with the small gear 28*b*2 of the dual gear 28*b* is engaged with the engagement large gear 98*b*1 to the rear dual gear 98*b* fixed to the rear end of the coupling shaft 93. The rear end of the coupling shaft 98 is reduced in diameter at the stepped portion 93*b*, and the diameter-reduced portion 93*c* has a D-shaped cross-section. The axial movement of the gear 98*d* is limited by the stepped portion 93*b* and a retaining ring 99 engaged in a groove extended in the circumferential direction of shaft portion 98*c* having the D-shaped cross-section. In the range of axial movement of the gear 98*d* together with the coupling shaft 93, the gears 98*c*, 98*d* are normally engaged with each other, by making the teeth width of the gear 98*c* larger than the teeth width of the gear 98*d*.

The dual gear 89*b* is crimped and fixed to the front plate 65 at one end thereof, and is rotatably supported on the small diameter portion 11*a* engaged to the rear plate 69, at the other end thereof. The dual gear 98*b* is limited in the axial position by the stepped portion 111*c* between the large diameter portion 111*b* and the small diameter motion 111*a* and the retaining ring 100 engaged in the circumstantial groove of the small diameter portion. The pinion gear 98*a* and the large gearing 98*b*1 of the dual gear 98*b* are helical gears.

The gear 98*c* is rotatably engaged with the small diameter portion 112*a* of the fixes shaft 112 fixed to the front plage 65 at one end, and the axial movement thereof is limited by the retaining ring 110 engaged in the circumstantial groove of the small diameter portion 112*a* and the stepped portion 112*c* between the large diameter shaft portion 112*b* and the small diameter portion 112*a* on the fixed shaft 112.

(Driving Device for Developing Roller)

FIG. 30 shows a driving-device portion of the main assembly of the apparatus for treading the developing roller 10*d*. A developing-device driving side coupling 68 is mounted disengageably on the developing-device coupling 39 coaxially with the developing device coupling 39 shown in FIG. 25. The coupling is in the form of claw clutch in which two projections and two complimentary recesses are engaged with each other to transmit the rotating force.

The developing-device driving side coupling 68 is engaged for axial movement with an axially movable coupling shaft 115, which is axially movable and rotatably supported by an unshown bearing engaged in a bracket 114 fixed to the front plate 65. The shaft portion of the coupling shaft 115, engaged with the developing-device driving side coupling 68, has a D-shape cross-section. A D-shaped hole of the coupling 68 is engaged with the shaft portion 115*a* of the D-shape cross-section, so that the coupling 68 and the coupling shaft 115 are rotated together. Retaining rings 116, 117 are engaged in two circumferential grooves at the front end of the coupling shaft 115 and the back side of the front plate 65. Between the developing device driving side coupling 68 and the bracket 114, a compression coil spring 118 is compressed and fitted around the coupling shaft 115.

The large gear 121*c*1 of the dual gear 121*c* is in meshing engagement with the pinion gear 121*a* fixed to the motor shaft of the motor 73 by way of the gear 121*b*, and the gear 121*d* in meshing engagement with the small gear 121*c*2 of the dual gear 121*c*1 is engaged with the gear 121C fixed to the rear end of the coupling shaft 115. The rear end of the coupling shaft 115 is reduced in diameter at a stepped portion 115*c*, and a small diameter portion 115*b* has a D-shaped prism and equilateral triangular prism recess, that is, a twisted recess has an equilateral triangular cross-section, and the axial movement of the gear 121C is limited by the stepped portion 115*c* and a retaining ring 122 engaged in the circumferential groove provided in the small diameter portion 115*b* having the D-shaped cross-section.

The gear 121*b*, the dual gear 121*c*, and the gear 121*d* are crimped into the front plate 65 at one side end, and are rotatably supported on the small diameter portions 123*a*, 124*a*, 125*a* of the fixed shafts 123, 124, 125 engaged with the gear plate 69, at the other end. Axial movements of the gears 121*b*, 121*c*, 121*d* are limited by the retaining rings 126, 127, 128 engaged in circumferential grooves of the small diameter portions 123*a*, 124*a*, 125*a* and the stepped portions 123*c*, 124*c*, 125*c* between the large diameter shaft portions 123*b*, 124*b*, 125*b* and the small diameter portions 123*a*, 124*a*, 125*b* of the fixed shafts 123, 124, 125. The pinion gear 121*a*, the gear 121*b* and the large gear 121*c*1 of the dual gear 121*c* are helical gears.

As described in the foregoing, the coupling 66 for driving the photosensitive drum 7 in the driving device E of the main assembly 14 of the apparatus, the charger driving-side 67, and the developing-device driving side coupling 68 therein, are driven by the motor 71 for driving the photosensitive drum, the motor 72 for driving the charging roller and the developing-roller driving motor 73, provided independently from each other, through the respective gear trains. Therefore, the photosensitive drum 7 is not interrelated with the charging roller 8*a*, the developing roller 10*d* or the stirring screws 10*g*, 10*h* or the like, so that the photosensitive drum 7 is not influenced by the variation in the load of the stirring screws 10*g* or, 10*h* or the like. When the photosensitive drum 7 is actuated, it is not influenced by the stirring-resistance load required by the stirring screws 10*g* and 10*h*, and is also free of the inertia load of the developing roller 10*d* or the inertia load of the gear train connecting the stirring screws 10*g*, 10*h* and the photosensitive drum 7. Therefore, the photosensitive drum 7 can be rotated at a constant speed without speed variation, and the speed rises quickly.

When the process cartridge B is mounted to the main assembly 14 of the apparatus in the longitudinal direction, the male coupling projection 37*d* of the coupling 37 integral with the photosensitive drum 7 is engaged with the female coupling recess 66*a* of the driving unit E provided in the main assembly 14 of the apparatus. When it is not engaged, the photosensitive drum driving coupling 66 is retracted to the right in the figure against the spring force of the compression coil spring 82 in the axial direction on the coupling shaft 77 in FIG. 28. Then, the end surfaces of the couplings 37, 66 are press-contacted. Therefore, when the motor 71 is rotated, the coupling 66 slides on the coupling shaft 77 with the spring force of the compression coil spring 82, and the male coupling projection 37*d* and the female coupling recess 66*a* are brought into engagement upon the alignment of the phase between the male coupling projection 37*d* and the female coupling recess 66*a*. At this time, the coupling 66 abuts the flange 77*a* at the end of the coupling shaft 77, by which the axial position thereof is determined. The male coupling projection 37*d* and the female coupling recess 66*a* have a twisted equilateral triangular prism and equilateral triangular prism recess, that is, a twisted recess has an equilateral triangular cross-section, respectively, which are loosely engaged, so that apex lines of the equilateral triangular prism of the male coupling projection 37*d* contact the surfaces of the twisted recess, so that a force attracting them toward each other is produced, and simultaneously, the axis of the photosensitive drum 7 and the coupling shaft 77 are centered or made correctly coaxial. By the attraction of the male coupling projection 37*d* and the female coupling recess 66*a* to each other, the leading end of the male coupling projection 37*d* abuts the flange 77*a* of the coupling shaft 77. The axial position of the coupling shaft 77 is determined relative to the driving unit E fixed to the main assembly 14 of the apparatus, so that by the abutment of the male coupling projection 37*d* to the coupling shaft 77, the axial position of the photosensitive drum 7 is determined relative to the main assembly 14 of the apparatus.

The coupling shaft 77 is attracted to the left in FIG. 28 when the male coupling projection 37*d* and the female coupling recess 66*a* are attracted toward each other, but the boss 74G3 of the large gear 74C abuts the bearing 78 having the flange positioned to the plate 65, and the retaining ring 81 abuts the large gear 74C.

When the process cartridge B is mounted to the main assembly 14 of the apparatus, the engaging actions occur between the male coupling projection 37*d* and the female coupling recess 66*a*, between the charger coupling 38 and the charger driving-side coupling 67 and between the developing-device coupling 39 and the developing-device, driving-side coupling 68*c*. At this time, the couplings 38, 67 and 39, 68 are engaged with each other as soon as the projections and the recesses are aligned to each other. When the projections are aligned with the projections, the charger coupling 38 and the developing device coupling 39 retract the charger driving-side coupling 67 and the developing-device, driving-side coupling 68 against the spring force of the compression coil springs 96, 118 on the coupling shafts 93 and 115 with sliding rotations. When the charging-roller driving motor 72, the developing-roller driving motor 73 are driven, and the charger driving-side coupling 67 and the developing-device, driving-side coupling 98 are rotated, the couplings 67, 68 advance with sliding on the shaft portions 93*a*, 115*a* when the phases thereof are aligned with the charger coupling 38 and the developing-device coupling 39 by the spring force of the compression coil springs 96, 118, by which the couplings 38 and 67 and the coupling 39 and 68 are engaged with each other.

When the photosensitive-drum driving motor 71 is rotated, the rotation is transmitted by way of the pinion gear 74*a*, the gear 74*b*, the dual gear 74*c*, the gear 74*d*, the large gear 74C and the coupling shaft 77, so that coupling 66, having the female coupling recess 66*a*, is rotated, and the photosensitive drum 7 is rotated by the rotation transmitted to the male coupling projection 37*d* from the female coupling recess 66*a*.

In the foregoing, the relative axial position of the middle gear for driving the photosensitive drum 7 is determined by the side surface of the gear and the flange, respectively. As described, the pinion 74*a* and the large gear 74C are supported, preventing the axial movement. In FIG. 28, the gears 74*b*, 74*d* are urged toward the right, and the dual gear 74*c* is urged toward the left by the thrust force, but the thrust is received by the flange and the side surface of the gear in each item, so that the axial positions of the gears 74*b*, 74*c*, 74*d* are determined among the gears 74*b*, 74*c*, 74*d* and are determined relative to the pinion gear 74*a*, large gear 74C. At this time, each gear side contacts the associated one of the flanges at a plurality of positions, so that when the side surface of one of the gears and the associated one of the flanges are contacted, the contact does not occur between other flanges and the side surface of the other gear. Therefore, the gears 74*b*, 74*c*, 74*d* are loosely retained between the stepped portions between the large diameter shaft portions 86*b*, 87*b*, 88*b* of the fixed shafts 86, 87, 88 and the small diameter portions 86*a*, 87*a*, 88*a* and the retaining rings 89, 91, 92, and the axial positions thereof relative to the fixed shafts 86, 87, 88 are not strictly determined.

(Relation Between the Clearance Retention Between the Developing Roller and the Photosensitive Drum and the Driving Gear of the Developing Roller)

Figure 31:
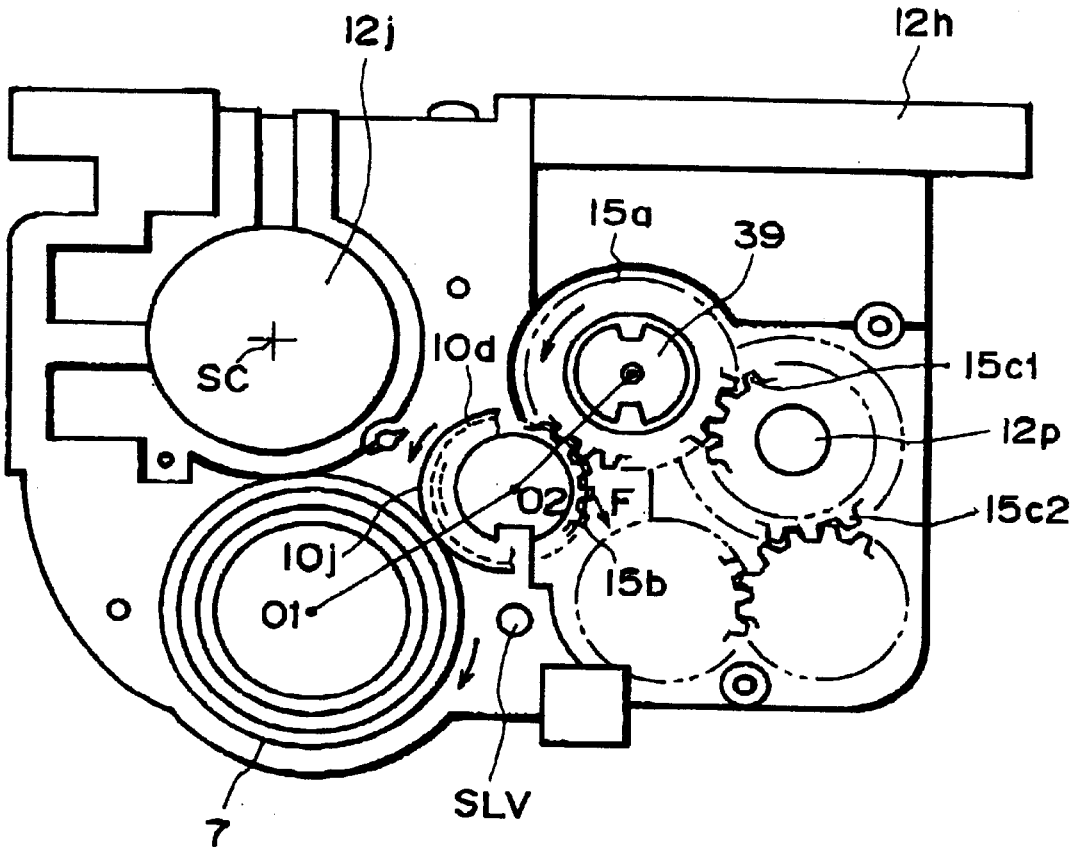
FIG. 31 is a rear view showing a load relation of a driving device for the developing roller.

FIG. 31 shows a weight relation when the rotating force is transmitted from the developing device coupling to the developing roller.

The gap is provided between the photosensitive drum 7 and the developing roller 10*d* by contacting a spacer roller 10*j* to the outer periphery of the photosensitive drum 7, the spacer roller 10*j* having a radius which is larger than the developing roller 10*d* by the development gap (The Gap Between the Surface of the Photosensitive Drum 7 and the Developing Roller 10*d* in the Developing Zone)

As described in the foregoing, the photosensitive drum 7 and the developing roller 10*d* are rotated in the same directions, and therefore, in the developing zone and at the opposite end portions thereof, the peripheral surfaces of the photosensitive drum 7 and the developing roller 10*d* move in the opposite directions. At the opposite sides of the developing roller 10*d*, journal portions 10*d*1 are provided, and the spacer roller 10J, which is coaxial with the journal portions 10*d*1, are rotatably supported longitudinally inside of the journal portions 10*d*1.

As has been described in conjunction with FIG. 18, the journal portion 10*d*1 is rotatably supported by bearing holes 32*a* of swingable arms 32, which is swingable about the pressing center SLv. The swingable arm 32 is pressed by a coil spring 35 to press-contact the spacer roller 10*j* to the photosensitive drum 7 at the longitudinally outside of the developing zone. Therefore, when the photosensitive drum 7 and the developing roller 10*d* are rotated, the spacer rollers 10J roll on the photosensitive drum 7 in the direction opposite from the direction of the developing roller 10*d*.

As shown in FIG. 31, when the developing device coupling 39 receives the rotating force from the coupling 68 of the driving unit of the main assembly 14 of the apparatus, the developing device coupling 39 and the driving gear 15*a* are rotated in the counterclockwise direction, and transmit the rotation from the driving gear 15*a* to the developing roller gear 15*b*, and therefore, the developing roller 10*d* rotates in the clockwise direction.

In this embodiment, all gears have generally involute gear shapes. The line of action of the teeth load F is a contact line inclined by the pressure angle relative to a tangent line of the pitch circle of the gears 15*a*, 15*b* at the pitch point P.

By such a parallel arrangement the line of action of the teeth load and the line connecting the bearing hole 32*a* of the swingable arm 32 that supports the roller and the center SLv of the swinging motion forms an angle in the range of ±30°, by which the influence of the teeth load to the press-contact force between the spacer roller 10J and the photosensitive drum 7, so that pressure provided by the compression coil spring 35 through the swingable arm 32 can be reduced. When the process cartridge B is not used, the press-contact force between the spacer roller 10J and the photosensitive drum 7 is small, thus suppressing the deformation of the spacer roller 10J by creep.

(Pressure Between the Charging Roller and the Photosensitive Drum)

Figure 32:
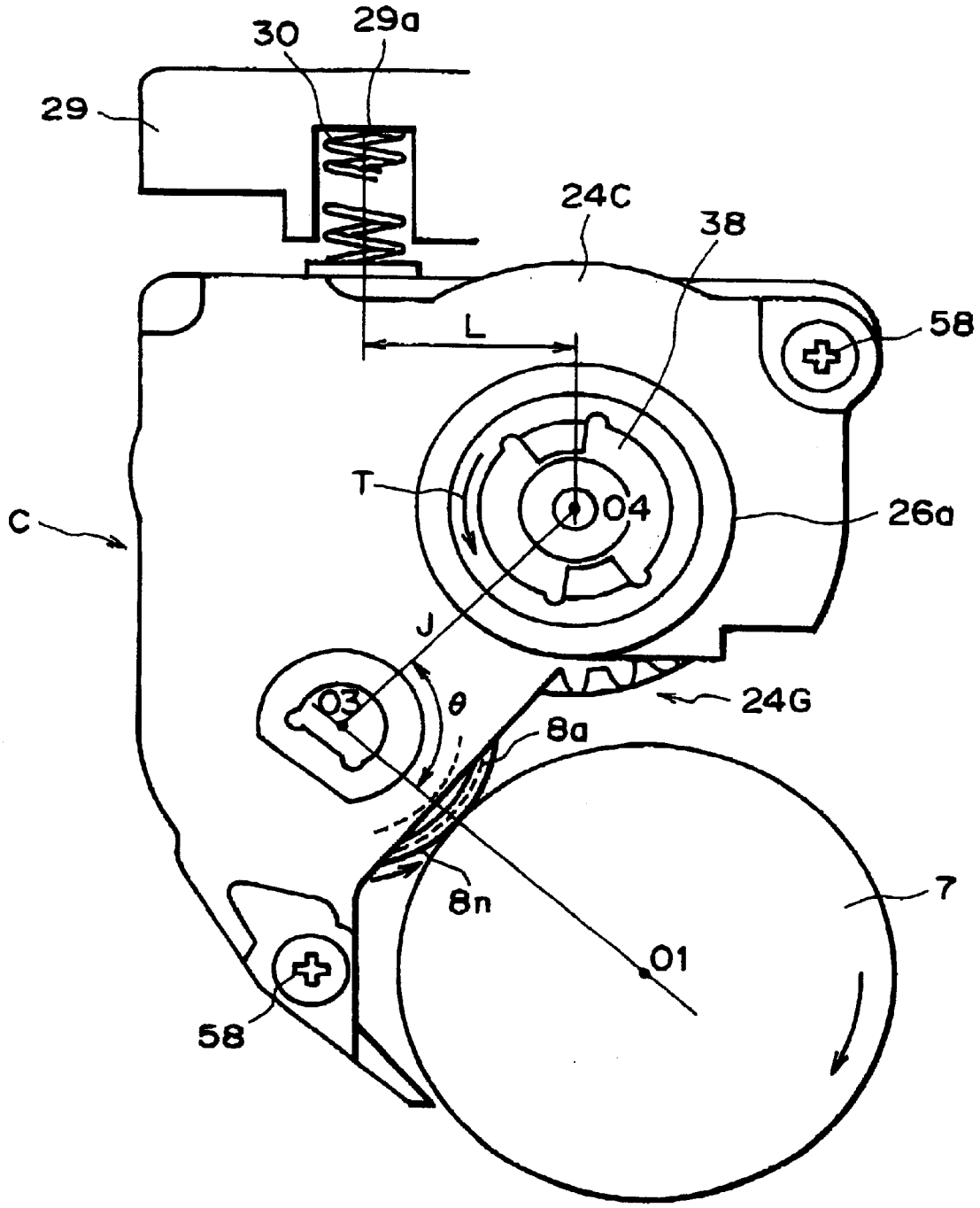
FIG. 32 is a rear view showing a relation of driving force for the charging roller.

FIG. 32 shows a weight relation when the rotating force is transmitted from the charger coupling to the charging unit comprising the charging roller.

Between the photosensitive drum 7 and the charging roller 8*a*, there is provided a gap for effecting magnetic brush charging, in which the charging roller 8*a* and the photosensitive drum 7 are electrically charged, and the untransferred toner remaining on the photosensitive drum 7 after the transfer operation is taken up to the rear portion of the charging roller 8*a*, and the toner is discharged back after the charge of the toner is adjusted. In order to provide the gap, a spacer roller 8*n* is rotatably mounted in the journal portion 8*a*2 of the developing roller 8*a*. The radius of the spacer roller 8*m* is larger than the radius of the developing roller 8*a* by the gap between the developing roller 8*a* and the photosensitive drum 7. The spacer roller 8*n* is press-contacted to the photosensitive drum 7 at the opposite sides of the charging region in the longitudinal direction of the photosensitive drum 7.

The photosensitive drum 7 and the charging roller 8*a* are rotated in the same rotational directions so that peripheral surfaces of the photosensitive drum 7 and the charging roller 8*a* move in the opposite directions.

The line connecting the center 03 of the charging roller 8*a* and the center 01 of the photosensitive drum 7 is substantially perpendicular to a line connecting the center 04 of the charger coupling 38 and the center 03 of the charging roller 8*a*. With approaching of the angle "Theta" to 180°, the torque T applied from the coupling 67 of the driving unit of the main assembly 14 of the apparatus to the charger coupling 38 is effective to urge the charging roller 8*a* to the photosensitive drum 7 except for the range in which the charging roller 8*a* receives the force toward the photosensitive drum 7 by wedge action. In FIG. 32, the center 03 of the charging roller 8*a* is desirably in the left side beyond the line connecting the center 01 of the photosensitive drum 7 and the center 04 of the charger coupling 38.

By the torque T applied to the charger coupling 38, the charging unit C tends to rotate in the counterclockwise direction about the centers of the cylindrical shaft portion 26*a* supporting the charging unit C and the hole 23*a* (FIG. 11). Assuming the distance between the center 03 of the charging roller 8*a* and the charger coupling 04 is J, the press-contact force T/J is produced between the spacer roller 8*n* of the charging roller 8*a* and the photosensitive drum 7.

The torque about the cylindrical shaft portion 26*a* and the hole 23*a* is Fs×L, where L is the distance between the center line of the compression coil spring 30 and the center 04 of the charger coupling 38, and Fs is the spring force provided by the compression coil spring 30, and by the torque, the press-contact force between the spacer roller 8*n* of the charging roller 8*a* and the photosensitive drum 7 is Fs×L/J.

Because of the structure described above, the press-contact force between the spacer roller 8*n* and the photosensitive drum 7 is enough even if the spring force of the compression coil spring 30 for urging the charging unit C is small. Therefore, when the process cartridge B has not yet been used, the press-contact force between the spacer roller 8*n* and the photosensitive drum 7 is small, so that deformation of the spacer roller 8*n* due to creep can be prevented.

(Cartridge Mounting Portion)

Figure 33:
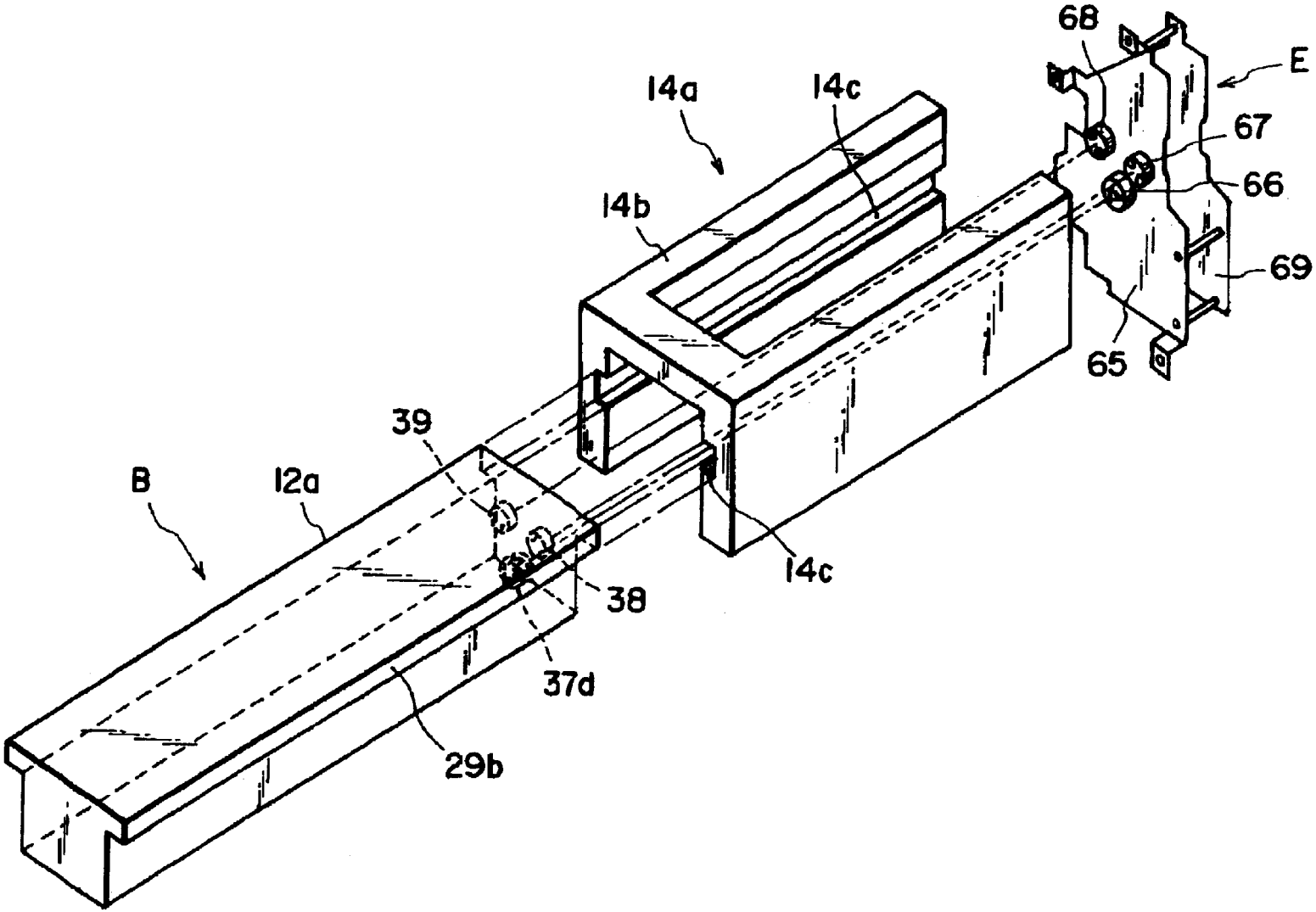
FIG. 33 is a perspective view of a cartridge mounting portion.

FIG. 33 shows one of the cartridge mounting portions. As shown in FIG. 33, each of the image formation stations 31Y, 31M, 31C, 31BK is provided with a cartridge mounting portion 14*a* in the main assembly 14 of the apparatus. The cartridge mounting portion 14*a* comprises a cartridge guide 14*b* and a driving unit E. The cartridge guide 14*b* is provided with a guiding 14*c* extending parallel with the surface of the recording material 2 and perpendicular to the feeding direction of the recording material 2. The guide portions 12*a*, 29*b* of the process cartridge B are engaged with the guiding 14*c*, and the process cartridge B is inserted or taken out.

When it is inserted into the cartridge mounting portion 14*a*, as described hereinbefore, the drum coupling 37*d* (male coupling projection), the charger coupling 38 and the developing device coupling 39 of the process cartridge B are brought into engagement with the couplings 66, 67, 68 of the driving unit E, respectively.

The provision of such a cartridge mounting portion is effective to simplify the structure of the main assembly of the apparatus in the case that a plurality of the driving forces are supplied to the process cartridge, independently. Additionally, the mounting and demounting of the process cartridge B relative to the main assembly of the apparatus is easy.

The embodiments of the present invention are summarized as follows:

1. A process cartridge detachably mountable to the main assembly 14 of the image forming apparatus, comprises an electrophotographic photosensitive drum 7, a developing roller 10*d* for developing with a developer an electrostatic latent image formed on the electrophotographic photosensitive drum 7, a developing frame 12 rotatably supporting the electrophotographic photosensitive drum 7, a swingable arm 32 (supporting member) swingably journaled in the developing frame 12 at a center parallel with the axis of the electrophotographic photosensitive drum 7 and rotatably supporting the developing roller 10*d* in parallel with the axis of the electrophotographic photosensitive drum 7 away from the center of the swinging motion, a compression coil spring 35 which is an urging member for urging the developing roller 10*d* toward the electrophotographic photosensitive drum 7, a spacer roller 10*j* rotatably mounted to the developing roller 10*d* as a positioning means relative to the photosensitive drum 7 of the developing roller 10*d*, and a developing blade 10*c*, fixed on a developing frame 12 adjacent the developing roller 10*d*, for regulating the toner carried to the developing zone for developing the image.

Because of this feature, the developing roller portion having a small inertia mass desirably follows the photosensitive drum (the development gap is maintained constant).

2. A process cartridge according to Paragraph 1, wherein the swingable arm 32, which is the supporting member, and the compression coil spring 35, which is an urging member, are disposed outside the developing zone in the longitudinal direction of the developing roller 10*d*.

3. A process cartridge according to Paragraph 2, wherein the swingable arm 32, which is the supporting member, and the compression coil spring 35, which is the urging member, are provided at the opposite sides of the developing roller 10*d* in the longitudinal direction.

4. A process cartridge according to Paragraph 1, 2 or 3, wherein a portion where the developing blade 10C is opposed to the developing roller 10*d* is disposed adjacent to the line connecting the center of the developing roller 10*d* and the center of swinging motion of the swingable arm 32, which is the supporting member. Because of this feature, the gap between the developing roller 10*d* and the developing blade 10C is not influenced by the manufacturing error in the swingable arm, the diameter of the developing roller, the diameter of the photosensitive drum, or the like.

5. A process cartridge according to Paragraph 4, wherein when the process cartridge B is mounted to the main assembly 14 of the image forming apparatus, the line connecting the center of the developing roller 10*d* and the center of the swinging motion of the swingable arm 32, which is supporting member, is substantially vertical, and the developing blade 10C is extended substantially along the vertical line.

6. A process cartridge according to any one of the Paragraphs 1–5, wherein the center of the swinging motion of the swingable arm 32, which is the supporting member, is substantially on a tangent line of the electrophotographic photosensitive drum or the developing roller at the position where they are opposed to each other in the developing zone, which tangent line is perpendicular to the line connecting the center of the developing roller 10*d* and the axis of the electrophotographic photosensitive drum 7. Because of this feature, the space occupied by the swingable arm can be reduced.

7. A process cartridge according to Paragraph 6, wherein the line connecting the axis of the electrophotographic photosensitive drum 7 and the center of the swinging motion of the swingable arm 32, which is the supporting member, and the line connecting the center of the developing roller 10*d* and the center of the swinging motion of the swingable arm 32, are substantially perpendicular to each other. Because of this feature, the manufacturing error of the swingable arm, the developing roller, and the photosensitive drum does hardly influence the position of the developing zone between the developing roller and the photosensitive drum.

8. A process cartridge according to any one of Paragraphs 1–7, wherein the spring force of compression coil spring 35 of the urging member is applied substantially in a direction perpendicular to a line connecting the center of the developing roller 10*d* and the center of the swinging motion of the swingable arm 32, which is the supporting member. Because of this feature, the compression coil spring does not receive oblique load.

9. A process cartridge according to Paragraph 8, wherein the urging member includes a compression coil spring 35 compressed between the developing frame 13 and the swingable arm 32, which is the supporting member, and is disposed at a rear side of the developing roller 10*d* as seen from the electrophotographic photosensitive drum 7.

10. A process cartridge according to Paragraph 1, wherein the swingable arm 32 is provided with a stopper portion 32*b* for abutting to the developing roller cover 36 as limiting means for limiting the movement of the developing roller 10*d* in the direction of urging by the compression coil spring 35, which is the urging member, when the electrophotographic photosensitive drum 7 is removed from the developing frame 13. Because of this feature, the disassembling and assembling of the process cartridge are made easier.

11. A process cartridge according to Paragraph 10, wherein the limiting means for limiting the movement of the developing roller limits the swinging motion of the swingable arm 32, which is the supporting member, to limit the movement of the developing roller 10*d*.

12. A process cartridge according to Paragraph 11, further comprising a fixed member in the form of a developing roller cover 36 for example, for blocking the movement, by the urging force, of the compression coil spring 35 by abutment with the swinging motion of the swingable arm 32 which is the supporting member.

13. A process cartridge according to any one of Paragraphs 1–12, further comprising a spacer roller 10*j* having a radius larger than the developing roller 10*d* by the development gap at each of the opposite ends of the developing roller 10*d*, wherein the spacer rollers 10*j* are press-contacted to the electrophotographic photosensitive drum 7 outside the image region.

The process cartridge provides the following advantages.

According to the foregoing embodiments, there is provided a process cartridge detachably mountable to the main assembly of the image forming apparatus, comprising an electrophotographic photosensitive drum, a developing roller for developing, with a developer, the electrostatic latent image formed on the electrophotographic photosensitive drum, a frame rotatably supporting the electrophotographic photosensitive drum, a supporting member swingably journaled to the swingable at the center parallel to the axis of the electrophotographic photosensitive drum and rotatably supporting the developing roller parallel to the axis of the electrophotographic photosensitive drum away from the center of the swinging motion, an urging member for urging the developing roller toward the electrophotographic photosensitive drum, positioning means for developing roller relative to the electrophotographic photosensitive drum, and a developing blade regulating the developer to be fed to the electrophotographic photosensitive drum to develop the image and fixed to the frame adjacent the developing roller. Therefore, the electrophotographic photosensitive drum can be supported in a rigid frame, and the developing roller can be correctly positioned relative to the electrophotographic photosensitive drum. The supporting member supports only the developing roller, so that it allows the electrophotographic photosensitive drum in a desirable manner to correctly keep the development gap. According to the embodiment, the supporting member and the urging member are disposed outside the developing zone in the longitudinal direction of the longitudinal direction.

According to the embodiment, the supporting member and the urging member are disposed at each of the opposite ends of the developing roller, so that supporting member can be supported close to the frame.

According to the embodiment, a portion where said developing blade is opposed to the developing roller is disposed adjacent a line connecting a center of rotation of the supporting member and a center of the developing roller, wherein the developing blade is effective to regulate the amount of a developer applied on a peripheral surface of said developing roller, so that the gap between the developing roller and the developing blade can be maintained constant despite the assembling error due to the manufacturing error of parts.

According to the embodiment, when said process cartridge is mounted to the main assembly of the electrophotographic image forming apparatus, a line connecting a center of rotation of the supporting member and a center of the developing roller is substantially vertical, and the developing blade is extended substantially along the vertical line, so that developer can be taken up from a bottom quadrant of the developing roller, and therefore, the supply of the developer is as mentioned above.

According to the embodiment, the center of rotation of the supporting member is disposed substantially on a tangent line of the electrophotographic photosensitive drum or the developing roller in a developing zone where they are opposed to each other, which line is perpendicular to a line connecting an axis of the electrophotographic photosensitive drum and a center of the developing roller, so that the urging direction of the developing roller toward the electrophotographic photosensitive drum is substantially aligned with a line connecting the centers of the electrophotographic photosensitive drum and the developing roller.

According to the embodiment, the line connecting the axis of the electrophotographic photosensitive drum and the center of rotation of the supporting member and the line connecting the center of the developing roller and the center of rotation of the supporting member are substantially perpendicular to each other, so that the center of the swinging motion of the supporting member can be close to the developing zone, and therefore, the members necessary for supporting the developing roller can be placed in a limited space, and then process cartridge can be downsized.

According to the embodiment, an elastic force of the urging member is applied in a direction substantially perpendicular to a line connecting the center of the developing roller and the center of rotation of the supporting member, so that a reaction force to the urging member is aligned with the urging direction of the urging member.

According to the embodiment, there is provided developing-roller, movement-limiting means for limiting movement of the developing roller in a direction of urging of the urging member when the electrophotographic photosensitive drum is dismounted from the frame, so it is possible that a swingable arm having the developing roller is mounted while the compression coil spring is held on the frame side, and then the electrophotographic photosensitive drum is mounted, and therefore, the assembly property is improved.

According to the embodiment, a limiting means is provided to limit the movement of the developing roller in the direction of urging of the urging member when the electrophotographic photosensitive drum is dismounted from the frame, so that when the mounting and dismounting of the electrophotographic photosensitive drum occurs, the developing roller does not move to the outside, and therefore, the assembling property is improved.

According to the embodiment, there is provided a fixing member for blocking movement of the supporting member by the urging force by abutment to the supporting member in a position for limiting rotation of the supporting member, so that outward movement of the developing roller can be easily stopped.

According to the embodiment, there is provided a fixing member for blocking movement of the supporting member by the urging force by abutment to the supporting member in a position for limiting rotation of the supporting member, so that the range of movement of the developing roller can be maintained very correctly. According to the embodiment, spacer rollers are provided at each of the opposite ends of the developing roller, and the spacer rollers are press-contacted to the electrophotographic photosensitive drum outside a developing zone, and the developing roller and the electrophotographic photosensitive drum are rotated in the same direction and, the spacer rollers can be rolled on the electrophotographic photosensitive drum despite the fact that the peripheral surfaces thereof are moved in the opposite directions.

As described in the foregoing, according to the present invention, the positional relation between the electrophotographic photosensitive drum and the developing roller can be maintained correctly.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, said process cartridge comprising:

an electrophotographic photosensitive drum;

a developing roller for developing an electrostatic latent image formed on said electrophotographic photosensitive drum with a developer;

a frame for rotatably supporting said electrophotographic photosensitive drum;

a developing blade, provided in said frame, for regulating the amount of the developer applied on a peripheral surface of said developing roller;

a supporting member, journaled in said frame for rotation about a center of rotation, for rotatably supporting said developing roller at a position away from the center of rotation thereof;

an urging member for elastically urging said supporting member to urge said developing roller toward said electrophotographic photosensitive drum;

means for limiting movement of said developing roller in a direction of urging of said urging member when said electrophotographic photosensitive drum is dismounted from said frame, wherein said means for limiting movement of said developing roller limits rotation of said supporting member to limit the movement of said developing roller; and a fixing member for blocking movement of said supporting member by an urging force of said urging member by abutment to said supporting member in a position for limiting rotation of said supporting member.

2. A process cartridge according to claim 1, further comprising spacer rollers provided at the opposite ends of said developing roller, wherein said spacer rollers are press-contacted to said electrophotographic photosensitive drum outside a developing zone of said developing roller.

3. A process cartridge according to claim 1, wherein said supporting member and said urging member are disposed outside a developing zone in a longitudinal direction of said developing roller.

4. A process cartridge according to claim 1, wherein said supporting member and said urging member are provided at each of the opposite ends of said developing roller.

5. A process cartridge according to claim 1, wherein a portion where said developing blade is opposed to said developing roller is disposed adjacent a line connecting the center of rotation of said supporting member and a center of rotation of said developing roller.

6. A process cartridge according to claim 5, wherein when said process cartridge is mounted to the main assembly of the electrophotographic image forming apparatus, the line connecting the center of rotation of said supporting member and the center of said developing roller is substantially vertical, and said developing blade is extended substantially along the vertical line.

7. A process cartridge according to claim 6, wherein the center of rotation of said supporting member is disposed substantially on a tangent line of said electrophotographic photosensitive drum or said developing roller in a developing zone, in which said electrophotographic photosensitive drum and said developing roller are opposed to each other, which line is perpendicular to a line connecting an axis of said electrophotographic photosensitive drum and the center of said developing roller.

8. A process cartridge according to claim 7, wherein the line connecting the axis of said electrophotographic photosensitive drum and the center of rotation of said supporting member and the line connecting the center of said developing roller and the center of rotation of said supporting member are substantially perpendicular to each other.

9. A process cartridge according to claim 8, wherein an elastic force of said urging member is applied in a direction substantially perpendicular to a line connecting the center of said developing roller and the center of rotation of said supporting member.

10. A process cartridge according to claim 9, wherein said urging member includes a coil spring compressed between said supporting member and said frame, and is disposed in a rear side of said developing roller as seen from said electrophotographic photosensitive drum.

11. A process cartridge detachably mountable to a main assembly of an electrophotographic image forming apparatus, said process cartridge comprising:

an electrophotographic photosensitive drum;

a developing roller for developing an electrostatic latent image formed on said electrophotographic photosensitive drum with a developer;

a frame for rotatably supporting said electrophotographic photosensitive drum;

a supporting member, rotatably mounted in said frame, for rotatably supporting said developing roller at a position away from a center of rotation thereof;

an urging member for elastically urging said supporting member to urge said developing roller toward said electrophotographic photosensitive drum;

means for limiting movement of said developing roller in a direction of urging of said urging member when said electrophotographic photosensitive drum is dismounted from said frame, wherein said means for limiting movement of said developing roller limits rotation of said supporting member to limit the movement of said developing roller;

a fixing member for blocking movement of said supporting member by the urging force of said urging member by abutment to said supporting member in a position for limiting rotation of said supporting member; and spacer rollers provided at each of the opposite ends of said developing roller, and wherein said spacer rollers are press-contacted to said electrophotographic photosensitive drum outside a developing zone.

12. A process cartridge according to claim 11, wherein said supporting member and said urging member are disposed outside the developing zone in a longitudinal direction of said developing roller.

13. A process cartridge according to claim 12, wherein said supporting member and said urging member are provided at each of the opposite ends of said developing roller.

14. A process cartridge according to claim 11, 12, or 13, wherein a portion where a developing blade is opposed to said developing roller is disposed adjacent a line connecting the center of rotation of said supporting member and a center of rotation of said developing roller.

15. An electrophotographic image forming apparatus for forming an image on a recording material, to which a process cartridge is detachably mountable, said apparatus comprising:

(a) a mounting member for detachably mounting the process cartridge, said process cartridge including:

an electrophotographic photosensitive drum;

a developing roller for developing an electrostatic latent image formed on said electrophotographic photosensitive drum with a developer;

a frame for rotatably supporting said electrophotographic photosensitive drum;

a developing blade, provided in said frame, for regulating the amount of the developer applied on a peripheral surface of said developing roller;

a supporting member, journaled in said frame for rotation about a center of rotation, for rotatably supporting said developing roller at a position away from the center of rotation thereof;

an urging member for elastically urging said supporting member to urge said developing roller toward said electrophotographic photosensitive drum;

means for limiting movement of said developing roller in a direction of urging of said urging member when said electrophotographic photosensitive drum is dismounted from said frame, wherein said means for limiting movement of said developing roller limits rotation of said supporting member to limit the movement of said developing roller; and a fixing member for blocking movement of said supporting member by an urging force of said urging member by abutment to said supporting member in a position for limiting rotation of said supporting member; and (b) a feeding member for feeding the recording material.

16. An electrophotographic image forming apparatus for forming an image on a recording material, to which a process cartridge is detachably mountable, said apparatus comprising:

(a) a mounting member for detachably mounting the process cartridge, said process cartridge including:

an electrophotographic photosensitive drum;

a developing roller for developing an electrostatic latent image formed on said electrophotographic photosensitive drum with a developer;

a frame for rotatably supporting said electrophotographic photosensitive drum;

a supporting member, rotatably mounted in said frame, for rotatably supporting said developing roller at a position away from a center of rotation thereof, an urging member for elastically urging said supporting member to urge said developing roller toward said electrophotographic photosensitive drum;

means for limiting movement of said developing roller in a direction of urging of said urging member when said electrophotographic photosensitive drum is dismounted from said frame, wherein said means for limiting movement of said developing roller limits rotation of said supporting member to limit the movement of said developing roller;

a fixing member for blocking movement of said supporting member by the urging force of said urging member by abutment to said supporting member in a position for limiting rotation of said supporting member; and spacer rollers provided at each of the opposite ends of said developing roller, and wherein said spacer rollers are press-contacted to said electrophotographic photosensitive drum outside a developing zone; and (b) a feeding member for feeding the recording material.

* * * * *